US009200790B2

(12) United States Patent
Lien et al.

(10) Patent No.: US 9,200,790 B2
(45) Date of Patent: Dec. 1, 2015

(54) DECORATIVE OBJECT THAT PRODUCES A COMPLIMENTARY SHADOW DESIGN

(71) Applicant: HALLMARK CARDS, INCORPORATED, Kansas City, MO (US)

(72) Inventors: Timothy Jay Lien, Lenexa, KS (US); Jason Blake Penrod, Shawnee, KS (US); Steve Eikos, Lenexa, KS (US); Robert D. Wertanen, Parkville, MO (US); Ma Lap Man, Hung Hom (HK); Wesley D. Lindquist, Kansas City, MO (US); Kari Jean Walberg, Overland Park, KS (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 132 days.

(21) Appl. No.: 13/928,518

(22) Filed: Jun. 27, 2013

(65) Prior Publication Data

US 2014/0003034 A1 Jan. 2, 2014

Related U.S. Application Data

(60) Provisional application No. 61/666,500, filed on Jun. 29, 2012, provisional application No. 61/799,300, filed on Mar. 15, 2013.

(51) Int. Cl.
*F21V 23/00* (2015.01)
*G09F 19/12* (2006.01)
(Continued)

(52) U.S. Cl.
CPC ..... *F21V 23/003* (2013.01); *F21V 23/007* (2013.01); *G09F 13/04* (2013.01); *G09F 19/12* (2013.01); *G09F 19/18* (2013.01)

(58) Field of Classification Search
CPC ..... G03B 21/00; G09F 19/18; G02F 19/12; F21V 23/003; F21V 23/007; F21S 10/007
USPC ..... 40/442
See application file for complete search history.

(56) References Cited

U.S. PATENT DOCUMENTS

| | | | | |
|---|---|---|---|---|
| 4,926,296 | A | 5/1990 | Blume et al. | |
| 5,597,230 | A | 1/1997 | Newman | |
| 6,685,347 | B2 * | 2/2004 | Grutze | 362/487 |

(Continued)

OTHER PUBLICATIONS

Canadian Office Action dated Jul. 2, 2015 in Application No. 2,819,860, 3 pages.

*Primary Examiner* — Robert May
(74) *Attorney, Agent, or Firm* — Shook, Hardy & Bacon L.L.P.

(57) ABSTRACT

Embodiments of the present invention use light to add human-like features to an inanimate object. In one embodiment, the object includes a film with an image that has been manipulated to provide for a low profile projection of an image onto a vertical surface directly adjacent to the object. For example, the image of a witch's head could be projected onto a wall and directly beneath, a witch's hat could be hanging on the wall. In another embodiment, changing lights and shadows are used to create animated objects out of otherwise inanimate objects. Various embodiments include components to create the illusion of changing facial expressions. These components include a plurality of light sources and an electronic device that controls the light sources to create the animation.

12 Claims, 28 Drawing Sheets

(51) Int. Cl.
*G09F 13/04* (2006.01)
*G09F 19/18* (2006.01)

(56) References Cited

U.S. PATENT DOCUMENTS 6,712,493 B2 3/2004 Tell et al.
6,789,932 B2 9/2004 Healy
7,086,770 B2 8/2006 Tell et al.
7,438,446 B1 * 10/2008 McCann ..... 362/341
8,714,799 B2 * 5/2014 Chien ..... 362/555
8,721,160 B2 * 5/2014 Chien ..... 362/641
2003/0189825 A1 10/2003 Tauch et al.
2005/0068762 A1 3/2005 Post
2005/0259446 A1 * 11/2005 Smith et al. ..... 362/641
2011/0085323 A1 4/2011 Chien

* cited by examiner

DECORATIVE OBJECT THAT PRODUCES A COMPLIMENTARY SHADOW DESIGN

CROSS-REFERENCE TO RELATED APPLICATIONS

This application claims the benefit of U.S. Provisional Application No. 61/666,500, filed Jun. 29, 2012, entitled "Decorative Object Which Produces Complementary Shadow Design" and U.S. Provisional Application No. 61/799,300, filed Mar. 15, 2013, entitled "Animated Objects Using Lighted Chambers." Both of the aforementioned applications are hereby incorporated by reference herein.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

Embodiments of the present invention use light to add human-like features to an inanimate object. The object includes a film with an image that has been manipulated to provide for a low profile projection of an image onto a vertical surface directly adjacent to the object. For example, the image of a witch's head could be projected onto a wall and directly beneath, a witch's hat could be hanging on the wall. The image on the film is distorted in order to produce the low profile projection of the face. In that regards, the face may not be readily visible or discernible in the film. The low angle projection of light through the film casts a shadow that is stretched out to create an image that appears normal (i.e., one that is not stretched or disproportioned).

Embodiments of the present invention provide technology for transforming a motionless decoration into an animated replication of a face with dynamic facial features that move in accordance with a soundtrack (e.g., music, vocal sounds, dialogue, or any other audible expression). As a result, the decorative object creates the illusion of changing facial expressions by selectively actuating lights that are mounted internally.

The decorative object includes various components to create the illusion of changing facial expressions. These components may include an exterior covering, an interior shell, an illumination chassis, a plurality of light sources, opaque pupils, and an electronic device. The exterior covering may comprise any material that hides the internal shell when the decorative object is deactivated, but serves as a projection screen when the decorative object is activated. The interior shell may be a rigid member that comprises a forward structure and a rearward structure, where the structures mate together and form the shape of the decorative object. As an alternative to a separate exterior covering and internal shell, a single translucent shell may be used.

The illumination chassis may be attached to the interior side of the decorative object's body. The illumination chassis includes partitions that divide the chassis into chambers. In operation, the chambers function to compartmentalize the facial features. Representative chambers include the following: one nose cavity, two eye cavities, and a plurality of mouth segments. Each of the chambers may include a back wall that fixedly holds in place one or more of the light sources (e.g., light-emitting diodes (LEDs) or bulbs). The back wall may be covered in a reflective material that directs light from the light source into the chamber. In one embodiment, the back wall of the nose cavity includes one light source, the back walls of the eye cavities include three light sources each, and the back walls of the mouth segments include one light source each.

In one embodiment, the opaque pupils covering part of the eye chamber are printed on or fastened to transparent film(s) that covers, at least part of the eye chamber. The transparent film(s) are assembled between the light sources within the eye chambers and the exterior body of the decorative object. Further, the transparent film(s) are assembled to the face frame such that the opaque pupils are substantially centered within the respective eye chambers. Accordingly, when light emitted from the light sources within the eye chamber strikes the opaque pupils, shadows are cast upon an interior surface of the exterior covering. These shadows appear to an observer to be pupils. In an alternate embodiment, the films can be omitted and each eye chamber can be comprised of multiple cavities activated similar to the mouth.

The electronic device is communicatively coupled to the light sources and is, among other things, configured to selectively actuate the light sources accordingly one or more animation schemes. As mentioned above, selective actuation serves to create the illusion of changing facial expressions on the decorative object. The animation schemes include the following pre-programmed sequences: 1) a talking scheme that makes the mouth of the jack-o'-lantern appear to be smiling, talking, smirking, and/or whistling; 2) a flashing scheme that makes a nose of the jack-o'-lantern appear to be turning on and off; and 3) a looking scheme that makes the eyes of the jack-o'-lantern appear to be changing direction, winking, and/or demonstrating various saccadic movements.

With respect to the talking scheme, the electronic device may selectively actuate the light sources within particular mouth segments according to their position within the mouth of the decorative object In one instance, if the talking scheme issues instructions to generate a small smile, the electronic device may energize just those light sources residing in an upper row of the mouth of the decorative object. In another instance, if the talking scheme issues instructions to generate a whistle, the electronic device may energize just those light sources residing in a central column of the mouth of the decorative object.

With respect to the looking scheme, the electronic device may selectively actuate particular light sources within each eye cavity according to their position within the eye of the decorative object (See FIGS. 18 and 19). In one instance, if the looking scheme issues instructions to generate a leftward glance, the electronic device may energize just the rightward light sources residing in both eye chambers of the decorative object. Energizing the rightward light sources within the eye chambers generates the illusion of a leftward glance because, when the light emitted from the rightward light sources strikes the opaque pupils, shadows emulating actual pupils are cast in a leftward location of the eyes of the decorative object. In another instance, if the looking scheme issues instructions to generate a wink, the electronic device may energize just those light source(s) residing in one eye cavity while de-energizing all the light sources within the other eye cavity.

The electronic device may comprise one or more modules to carry out the functionality above. These modules include a memory component, a processing component, and a power source. The memory component may store the various animation schemes. The processing component may access the animation schemes at the memory component and execute one or more of the animation schemes by selectively actuating the light sources over a wired or wireless communicative coupling. The power source (e.g., batteries) may supply power to the memory and processing components of the electronic device, as well as the light sources, speaker(s) for broadcasting the soundtrack, and/or motion sensor(s).

BRIEF DESCRIPTION OF THE DRAWINGS

An embodiment of the present invention is described in detail below with reference to the attached drawing figures, wherein.

DETAILED DESCRIPTION

Figure 1:
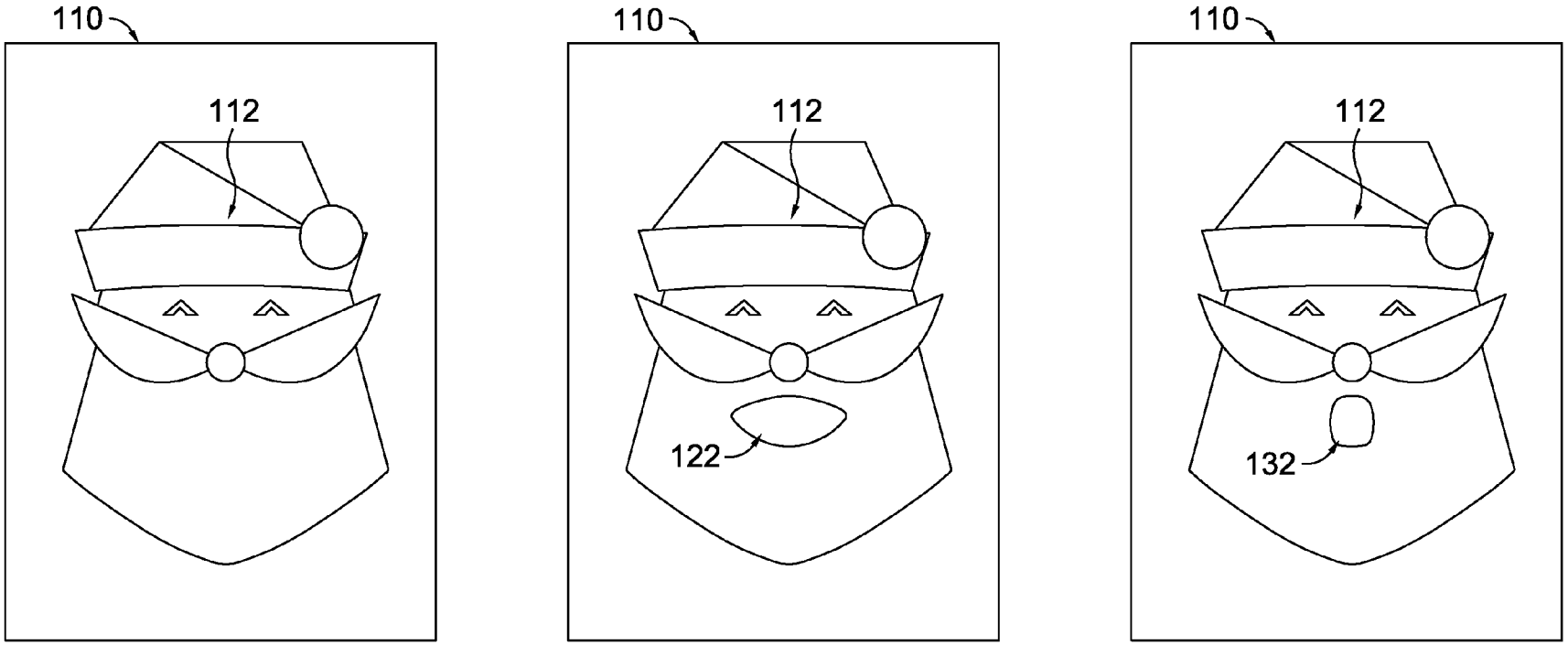
FIG. 1 depicts a static greeting card with a printed character with light and sound electronics, in accordance with an embodiment of the present invention.

The subject matter of embodiments of the invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Embodiments of the present invention use light to add human-like features to an inanimate object. The object includes a film with an image that has been manipulated to provide for a low profile projection of an image onto a vertical surface directly adjacent to the object. For example, the image of a witch's head could be projected onto a wall and directly beneath, a witch's hat that is hanging on the wall. The image on the film is distorted in order to produce the low profile projection of the face. In that regards, the face may not be readily visible or discernible in the film. The low angle projection of light through the film casts a shadow that is stretched out to create an image that appears normal (i.e., one that is not stretched or disproportioned).

In another embodiment, changing lights and shadows are used to create animated objects out of otherwise inanimate objects. Embodiments of the present invention provide technology for transforming a motionless decoration into an animated replication of a face with dynamic facial features that move in accordance with a soundtrack (e.g., music, vocal sounds, dialogue, or any other audible expression). As a result, the decorative object creates the illusion of changing facial expressions by selectively actuating lights that are mounted internally.

The decorative object includes various components to create the illusion of changing facial expressions. These components may include an exterior covering, an interior shell, an illumination chassis, a plurality of light sources, opaque pupils, and an electronic device. The exterior covering may comprise any material that hides the internal shell when the decorative object is deactivated, but serves as a projection screen when the decorative object is activated. The interior shell may be a rigid member that comprises a forward structure and a rearward structure, where the structures mate together and form the shape of the decorative object. As an alternative to a separate exterior covering and internal shell, a single translucent shell may be used.

The illumination chassis is may be attached to the interior side of the decorative object's body. The illumination chassis includes partitions that divide the chassis into chambers. In operation, the chambers function to compartmentalize the facial features. Representative chambers include the following: one nose cavity, two eye cavities, and a plurality of mouth segments. Each of the chambers may include a back wall that fixedly holds in place one or more of the light sources (e.g., light-emitting diodes (LEDs) or bulbs). The back wall may be covered in a reflective material that directs light from the light source into the chamber. In one embodiment, the back wall of the nose cavity includes one light source, the back walls of the eye cavities include three light sources each, and the back walls of the mouth segments include one light source each.

In one embodiment, the opaque pupils covering part of the eye chamber are printed on or fastened to transparent film(s) that covers, at least part of the eye chamber. The transparent film(s) are assembled between the light sources within the eye chambers and the exterior body of the decorative object. Further, the transparent film(s) are assembled to the face frame such that the opaque pupils are substantially centered within the respective eye chambers. Accordingly, when light emitted from the light sources within the eye chamber strikes the opaque pupils, shadows are cast upon an interior surface of the exterior covering. These shadows appear to an observer to be pupils. In an alternate embodiment, the films can be omitted and each eye chamber can be comprised of multiple cavities activated similar to the mouth.

The electronic device is communicatively coupled to the light sources and is, among other things, configured to selectively actuate the light sources accordingly one or more animation schemes. As mentioned above, selective actuation serves to create the illusion of changing facial expressions on the decorative object. The animation schemes include the following pre-programmed sequences: 1) a talking scheme that makes the mouth of the jack-o'-lantern appear to be smiling, talking, smirking, and/or whistling; 2) a flashing scheme that makes a nose of the jack-o'-lantern appear to be turning on and off; and 3) a looking scheme that makes the eyes of the jack-o'-lantern appear to be changing direction, winking, and/or demonstrating various saccadic movements.

With respect to the talking scheme, the electronic device may selectively actuate the light sources within particular mouth segments according to their position within the mouth of the decorative object In one instance, if the talking scheme issues instructions to generate a small smile, the electronic device may energize just those light sources residing in an upper row of the mouth of the decorative object. In another instance, if the talking scheme issues instructions to generate a whistle, the electronic device may energize just those light sources residing in a central column of the mouth of the decorative object.

Figure 18:
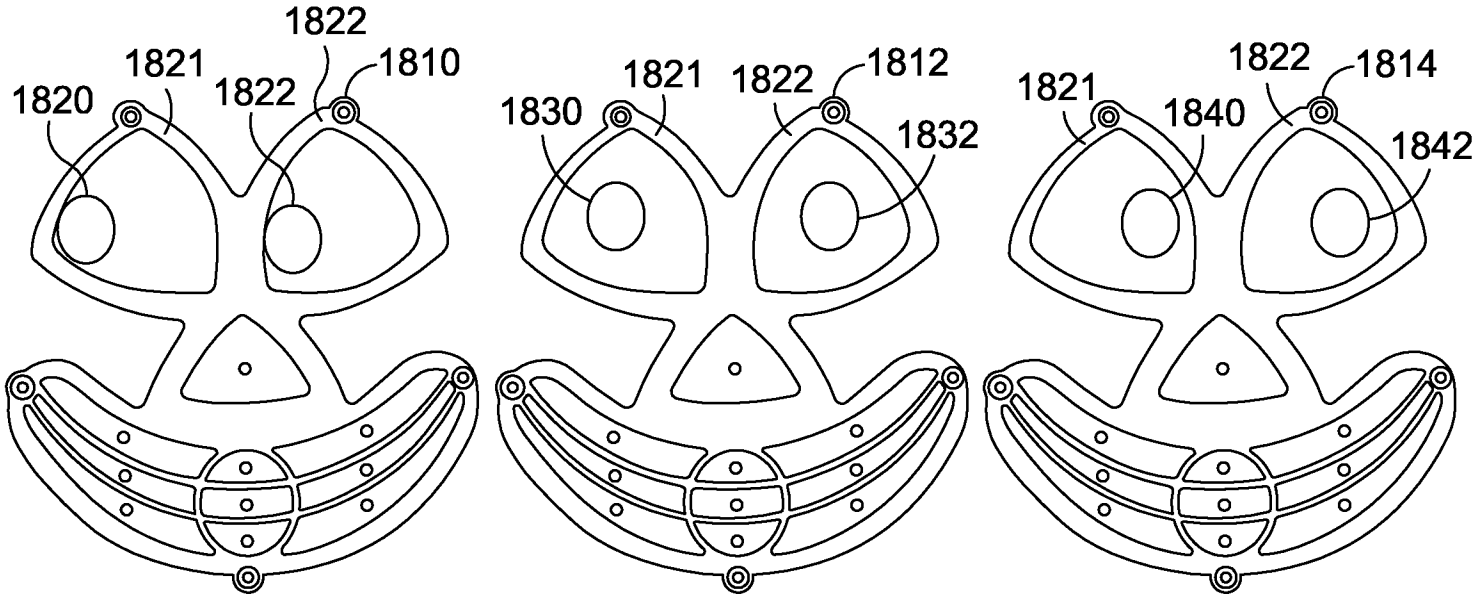
FIGS. 18-19 depict facial expression using specific illuminated chambers, in accordance with an embodiment of the present invention.
Figure 19:
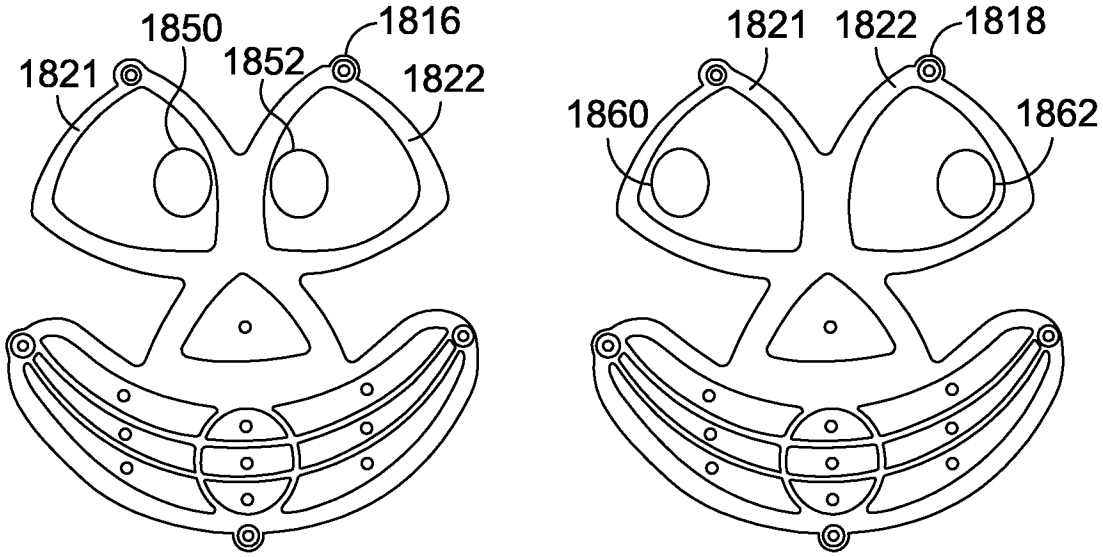

With respect to the looking scheme, the electronic device may selectively actuate particular light sources within each eye cavity according to their position within the eye of the decorative object (See FIGS. 18 and 19). In one instance, if the looking scheme issues instructions to generate a leftward glance, the electronic device may energize just the rightward light sources residing in both eye chambers of the decorative object. Energizing the rightward light sources within the eye chambers generates the illusion of a leftward glance because, when the light emitted from the rightward light sources strikes the opaque pupils, shadows emulating actual pupils are cast in a leftward location of the eyes of the decorative object. In another instance, if the looking scheme issues instructions to generate a wink, the electronic device may energize just those light source(s) residing in one eye cavity while de-energizing all the light sources within the other eye cavity.

The electronic device may comprise one or more modules to carry out the functionality above. These modules include a memory component, a processing component, and a power source. The memory component may store the various animation schemes. The processing component may access the animation schemes at the memory component and execute one or more of the animation schemes by selectively actuating the light sources over a wired or wireless communicative coupling. The power source (e.g., batteries) may supply power to the memory and processing components of the electronic device, as well as the light sources, speaker(s) for broadcasting the soundtrack, and/or motion sensor(s).

General steps for generating an illusion of changing facial expressions are listed immediately below. Changes to the facial expression of the decorative object may be carried out by the following steps: 1) detecting a trigger event (e.g., using motion sensor(s) to detect physical movement proximate to a decorative object, detecting selection of a start button on the decorative object, and automatic initiation by the controller after a threshold period of time); 2) activating an electronic device to carry out one or more animation schemes by selectively actuating light sources within a face frame of the decorative object; 3) activating the electronic device to broadcast a soundtrack from one or more speakers, where the soundtrack corresponds with the facial expressions generated by the selectively actuated light sources; and 4) deactivating the electronic device upon the expiration of a predefined period of time, where the decorative object reassumes the appearance of a pumpkin decoration.

Computer-readable media can be any available media that can be accessed by computing device 100 and includes both volatile and nonvolatile media, removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules or other data.

Computer storage media includes RAM, ROM, EEPROM, flash memory or other memory technology, CD-ROM, digital versatile disks (DVD) or other optical disk storage, magnetic cassettes, magnetic tape, magnetic disk storage or other magnetic storage devices. Computer storage media does not comprise a propagated data signal.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer-storage media does not include communications media. Combinations of any of the above should also be included within the scope of computer-readable media.

In one embodiment, a method to change the facial expression of the decorative object is performed. The method comprises detecting a trigger event (e.g., motion sensor(s) to detect physical movement proximate to a decorative object). The method also comprises activating an electronic device to carry out one or more animation schemes by selectively actuating light sources within a face frame. The method also comprises activating the electronic device to broadcast a soundtrack from one or more speakers, where the soundtrack corresponds with the facial expressions generated by the selectively actuated light sources. The method also comprises deactivating the electronic device upon the expiration of a predefined period of time, where the object reassumes the appearance of a static decoration.

An embodiment of the present invention makes use of lights and shadows to create an animated greeting card. A lighted chamber construction is concealed in a greeting card and lights therein are activated upon a triggering event (e.g., opening the greeting card or pressing a button). Referring to FIG. 1, an apparently static greeting card 110 with a printed character 112 (i.e., Santa Clause, etc.) on the front panel appears to "come to life" as light illuminates areas of the surface through the card's paper stock to generate smile 122 and "Oh" 132. The light-generated features of the character may be synchronized with audio (e.g., voice and sound).

The light can come from Light Emitting Diodes (LEDs) that are in a light assembly that is installed behind the card's front cover. In one embodiment, the LEDs can be concealed between two panels of the card that form the front cover. Light passes from the light assembly into an illumination chassis that comprises one or more light chambers. The illumination chassis and the light assembly may take the form of a facial feature, such as the shape of a mouth (or other possible facial features). Special and/or individual chambers of the illumination chassis channel the light in each activated chamber to the rear of the front panel to illuminate and define the desired shapes of the facial features to a person viewing the front of the card. The switching of individual LEDs in specific sequences and in specific chambers illuminate different shapes that work together to create unique mouth expressions (or any other features, facial or otherwise).

Figure 2:
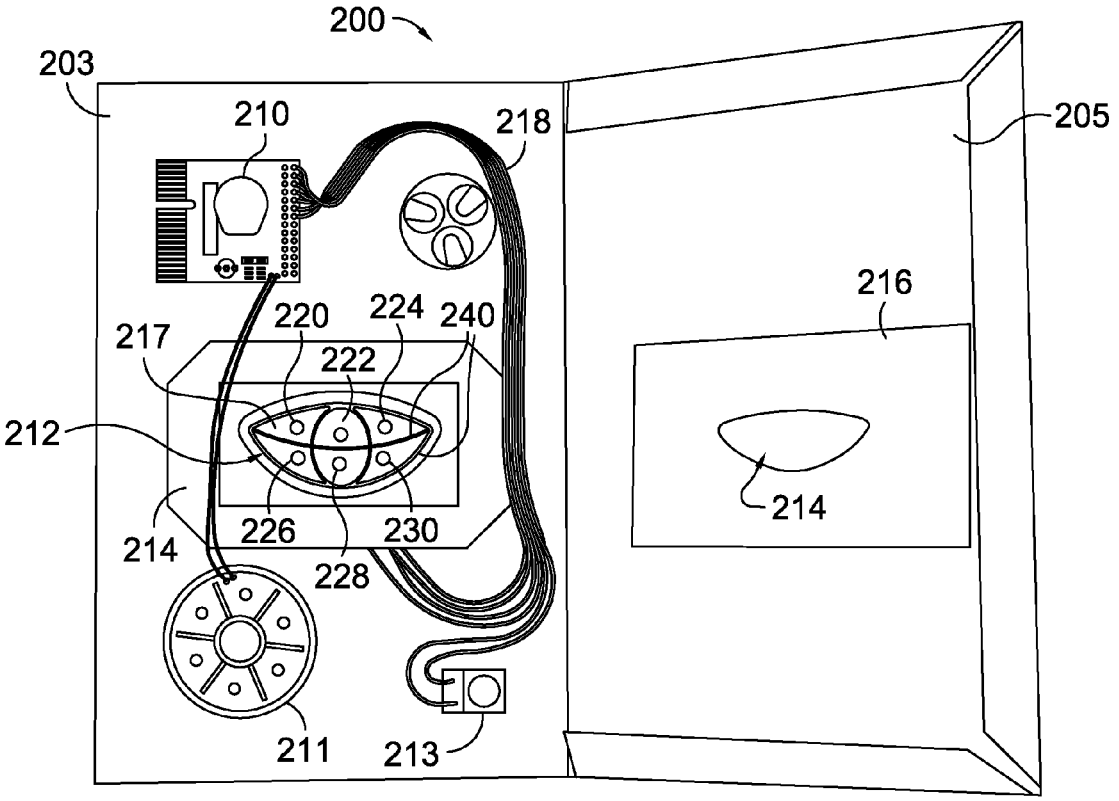
FIG. 2 depicts an inner card with light chamber assembly and light and sound electronics, in accordance with an embodiment of the present invention.
Figure 4:
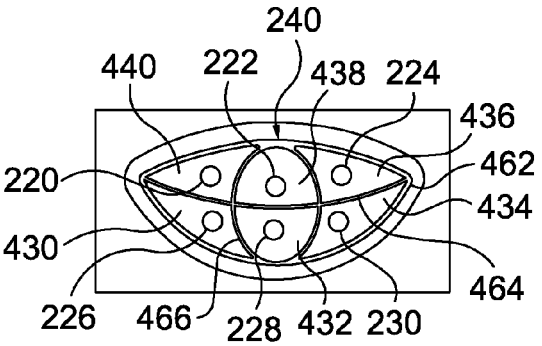
FIG. 4 depicts a mouth-shaped illumination chassis, in accordance with an embodiment of the present invention.

Referring to FIG. 2, the card body 200 houses the illumination chassis 240, and electronic controller 210, speaker 211, switch 213, and the light chamber assembly 212. The various electronic components are connected to each other with electrical wires 218. The light assembly 212 may contain light sources (220, 222, 224, 226, 228, and 230) aligned with the light chambers in the illumination chassis 240. The light sources may be LEDs. The illumination chassis is described in more detail in FIG. 4. The card body 200 also includes a reflective mouth mask 216, which is mounted to the reverse side of the front panel 205, and serves to mask the area surrounding the mouth so that the light from the chamber is contained and crisp in appearance when shining through the mouth opening 214 in the front panel. A reflective sheet 217 or sheets are installed behind the light chassis 240 and light assembly 212 in a location to reflect light from the light sources into the illumination chassis 240 and toward the rear surface of the front panel 205.

Figure 3:
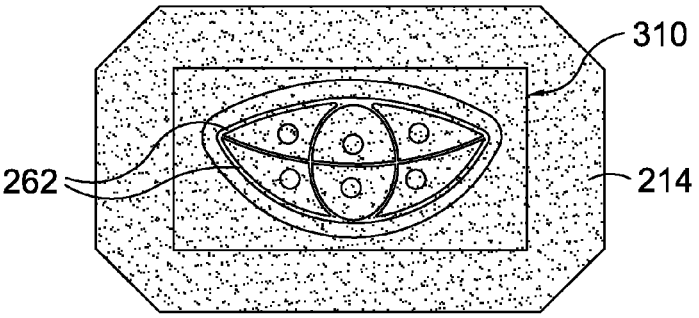
FIG. 3 depicts a reflective light mask, in accordance with an embodiment of the present invention.

Referring to FIG. 3, a foam light diffuser 310 (shown as a rectangle) is installed on top of the illumination chassis 240 and between the front panel 205. A function of the light diffuser 310 is to achieve an even lighting effect throughout the area of the chamber (i.e. to avoid a hot spot immediately in front of the LED). The light diffuser 310 also serves to soften the hard edge appearance of the light from each individual light chamber and also to help mesh the light chamber assembly closely to the front panel 205 of the card when closed. The mask 214 has an opening 262 that is sized to fit around the light assembly 212 and illumination chassis 240. The mask 214 is used to protect and soften the edges of the light chamber so that the entire assembly fits inside the card 200 without bulging or cutting through the card stock.

In the embodiment shown, the feature to be animated is a mouth via a (mouth) shaped illumination chassis (See FIG. 4) that is made up of a group of six individual chambers 430, 432, 434, 436, 438, and 440, each receiving light from one LED. Each light chamber is defined by an exterior partition. The light chamber is not part of the light source. In other words, the light chamber not a covering for a light bulb or part of the light source. In one embodiment, the area across the opening of the light chamber is more than 5 times greater than the cross-sectional area of a light source. In another embodiment, the light chamber is more than 10 times greater than the cross-sectional area of a light source. Partitions shown in FIG. 4 include an exterior wall 462, a center wall 464, and a central wall 466 in the shape of an oval. In one embodiment, the partitions are vertical. The number of LED lights might be different for another type of light chamber (i.e., eye or nose). The LEDs may be positioned within the relative center of each individual chamber to distribute light evenly through the chamber. Turning the LEDs on will cause a given chamber to illuminate, projecting the shape of the given chamber through the card panel.

Figure 5:
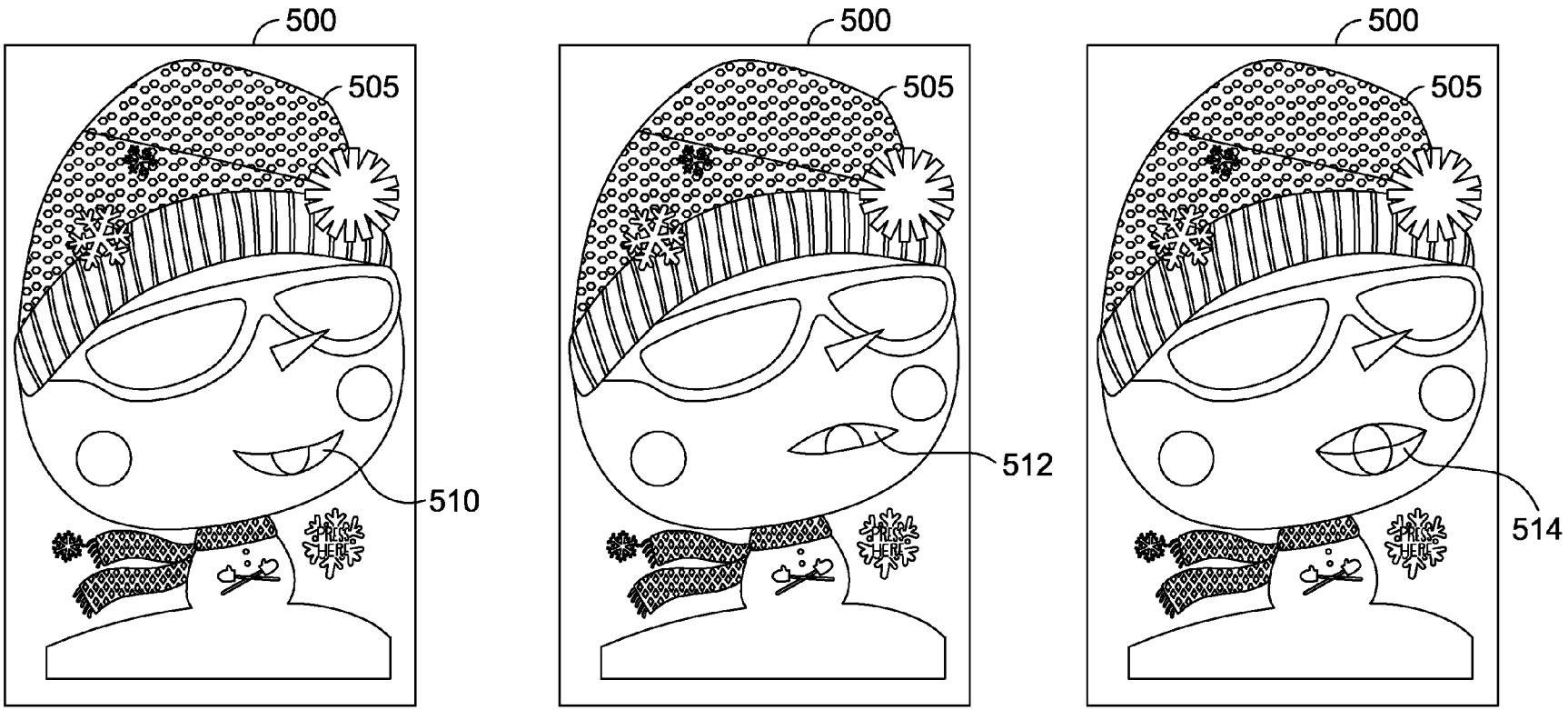
FIG. 5 depicts a snowman with mouth expressions achieved by lighting different lights/chambers, in accordance with an embodiment of the present invention.
Figure 6:
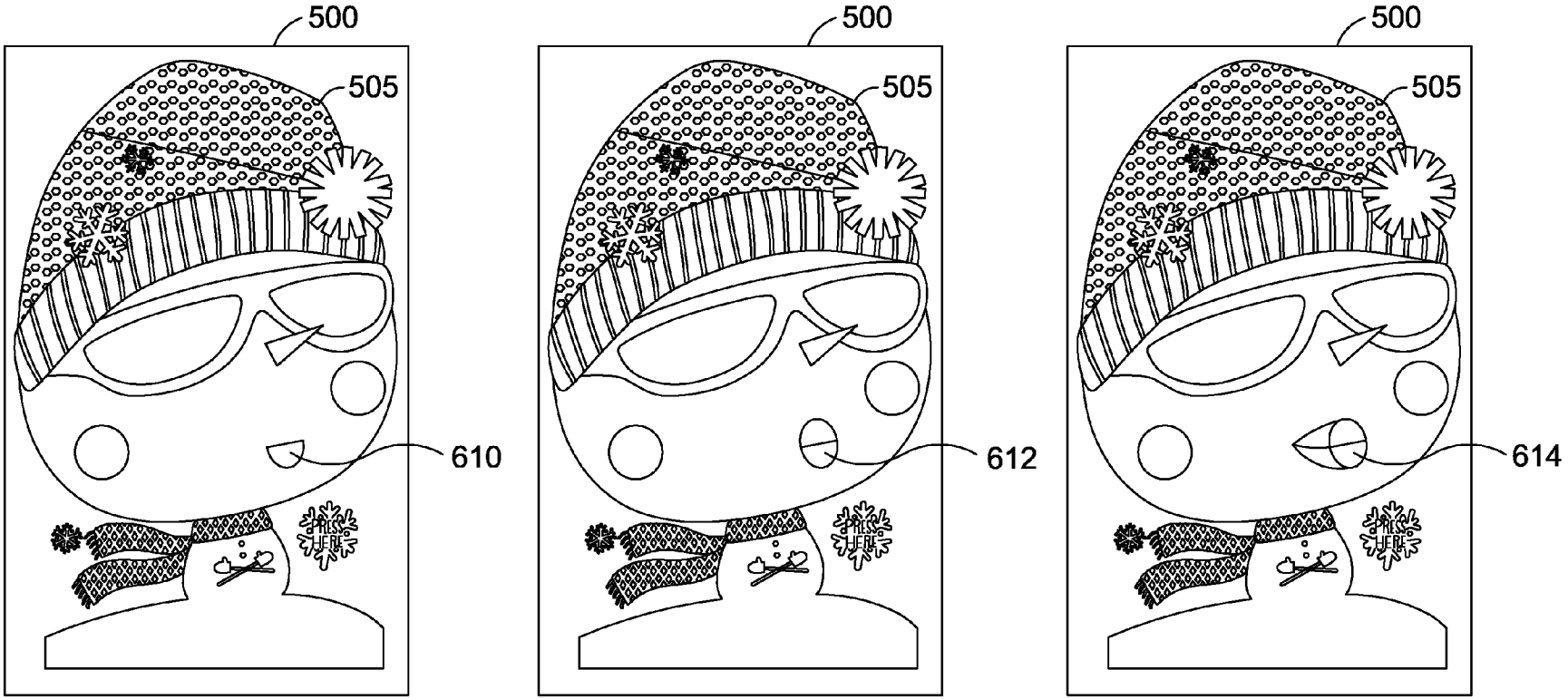
FIG. 6 depicts more mouth expressions achieved by lighting different lights/chambers, in accordance with an embodiment of the present invention.

In an embodiment, the light assembly and illumination chassis of FIG. 2. are used to create different facial expressions on a card 500 having an image of a snowman's head 505. Referring to FIGS. 5 and 6, several different mouth expressions can be achieved by lighting different lights/chambers. Some examples are: half-opened mouth, lower (half smile) 510; half-opened mouth, upper (frown) 512; fully opened mouth (big smile) 514; mouth opened to a half circle, lower ("Uh" expression) 610; mouth opened to a full circle ("Oh" expression) 612; left or right side of mouth open (smirk) 614. Changing the mouth between the various expressions and varying degrees of smile or frown, synchronized with voice audio will create an animated speaking-mouth effect.

Figure 7A:
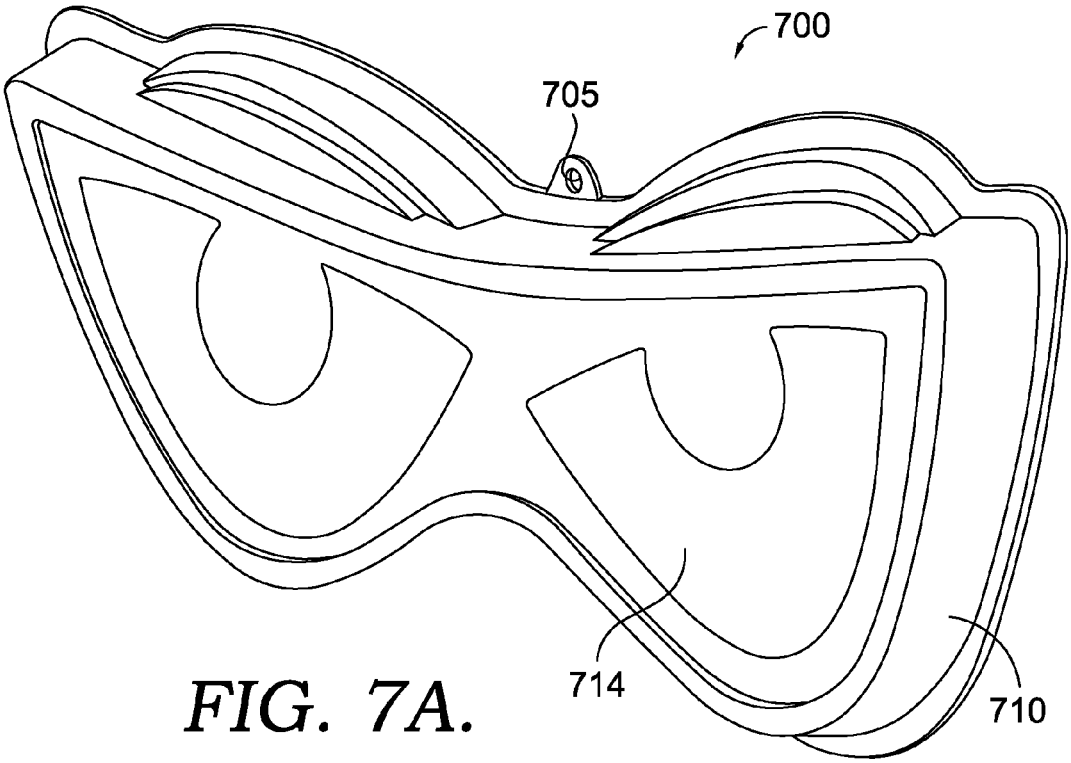
FIGS. 7A-7B depict a door hanger shaped to resemble a pair of eyes, in accordance with an embodiment of the present invention.
Figure 7B:
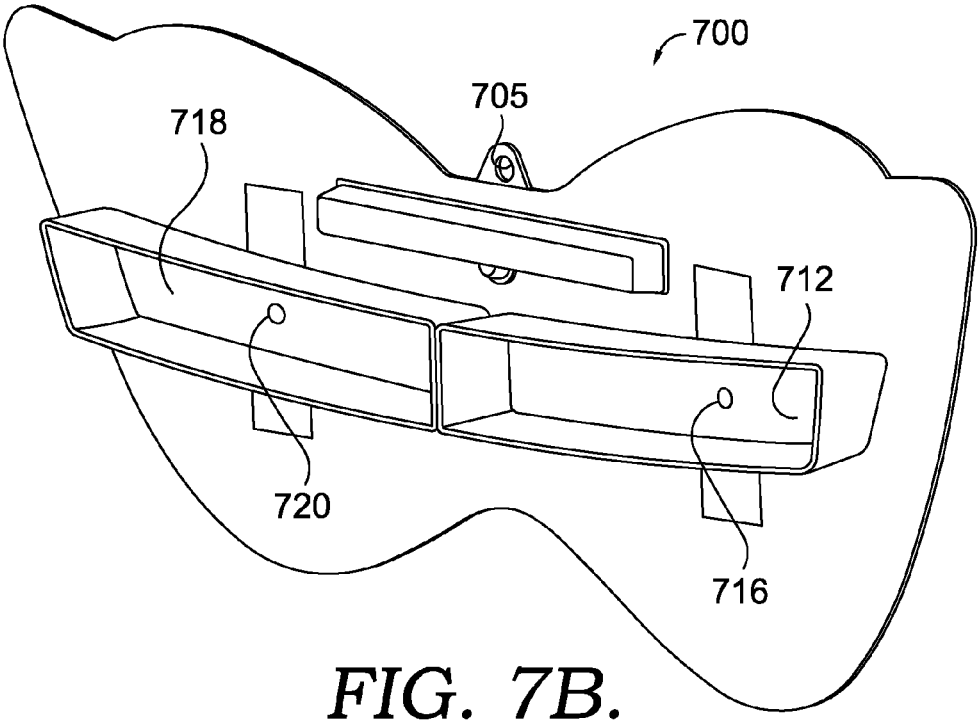

FIGS. 7A and 7B depict an item 700 that uses light and shadow to create scary eyes. The item 700 may be hung on a surface, such as a door or wall, using mounting hole 705. Lights therein can be activated to animate the eyes with light patterns of different shapes corresponding to shapes of individual chambers of the illumination chassis. The housing 710 includes hollow chambers 712 and 718 for receiving the illumination chassis, the lights, the electronics, and a power supply. The front of this item is a two-piece construction with the outer housing 710 being one piece and the yellow U-shaped areas under the eyes being another piece 714. Chambers 712 and 718 or light baffles are positioned behind the two-piece front (See FIG. 7B). In one embodiment, the item 700 includes an interior light source(s) and film(s) including one or more images that complement the item 700. Light shines across the film to project a mouth below the eyes that is only visible when the light source is on. There may be two light sources and two film images to create two mouth shapes of different size and position. Sequencing between these two mouth images creates the illusion of a moving mouth, synchronized with voice audio. The projection from item 700 may be similar to the projections described with reference to FIGS. 25-28 and may include the use of low angle projections on a surface onto which the item 700 is hanging.

Similar to the greeting card concept above, the lighted chambers concept can be used to illuminate other items, such as an animated jack-o'-lantern, or as the snowman head.

Figure 8:
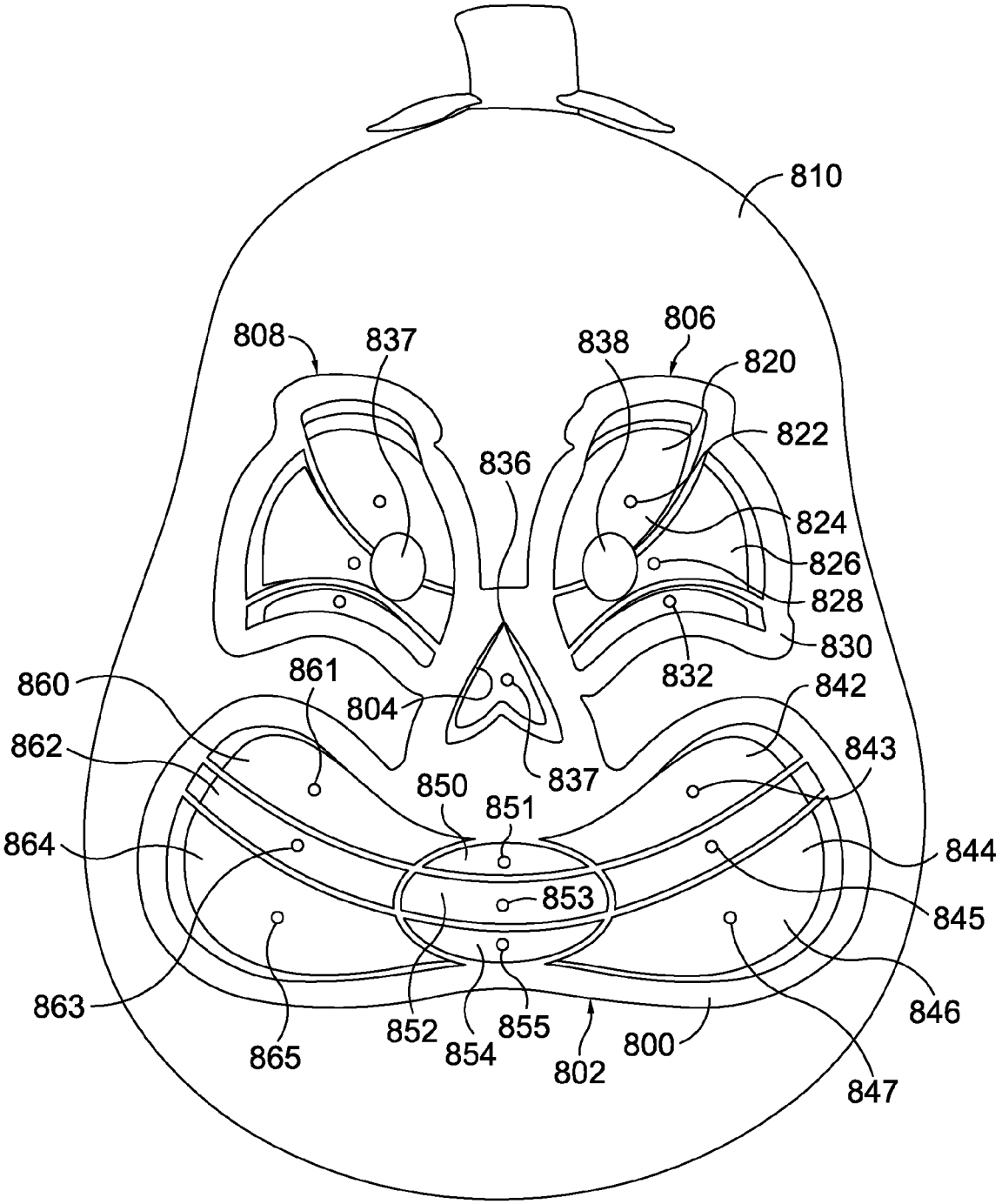
FIG. 8 depicts a jack-o'-lantern with light chambers, in accordance with an embodiment of the present invention.

Referring to FIG. 8, a pumpkin or jack-o'-lantern housing 810 may be employed to house a light assembly and illumination chassis 800. FIG. 8 shows the light assembly and illumination chassis 800 with an outer housing removed. The illumination chassis 800 would fit against the interior side of the jack-o'-lantern housing 810. The illumination chassis includes a mouth section 802, a nose section 804, and right eye 806 and left eye 808 sections. Thus, the illumination chassis 800 may animate multiple facial features.

The right eye section 806 includes three illumination chambers each having a single light source. The illumination chambers are three-dimensional and include exterior walls, an opening for the light source and an opening for light to pass through on to a translucent surface. In this case, the translucent service would be the exterior of the jack-o'-lantern housing 810. The illumination chambers in the right eye section 806 include chamber 824, chamber 826, and chamber 830. Chamber 824 receives light from LED 822. Chamber 826 receives light from LED 828. And chamber 830 receives light from LED 832. The left eye 808 includes a similar arrangement of chambers and LEDs. Each eye has an obstruction that forms a shadow in the shape of a pupil. Obstruction 838 is opaque and creates a shadow effect for chamber 806. Obstruction 837 forms a pupil-shaped shadow for left eye chamber 808.

Nose feature 804 is formed by a single chamber 836. Chamber 836 receives light from LED 837.

The mouth 802 is formed by nine illumination chambers. Illumination chamber 842 receives light from LED 843. Illumination chamber 844 receives light from LED 845. Illumination chamber 846 receives light from LED 847. Illumination chamber 850 receives light from LED 851. Illumination chamber 852 receives light from LED 853. Illumination chamber 854 receives light from LED 855. Illumination chamber 860 receives light from LED 861. Illumination chamber 862 receives light from LED 863. Illumination chamber 864 receives light from LED 865. As shown in more detail below, activating one or more of the LEDs can create different facial animations.

Figure 9:
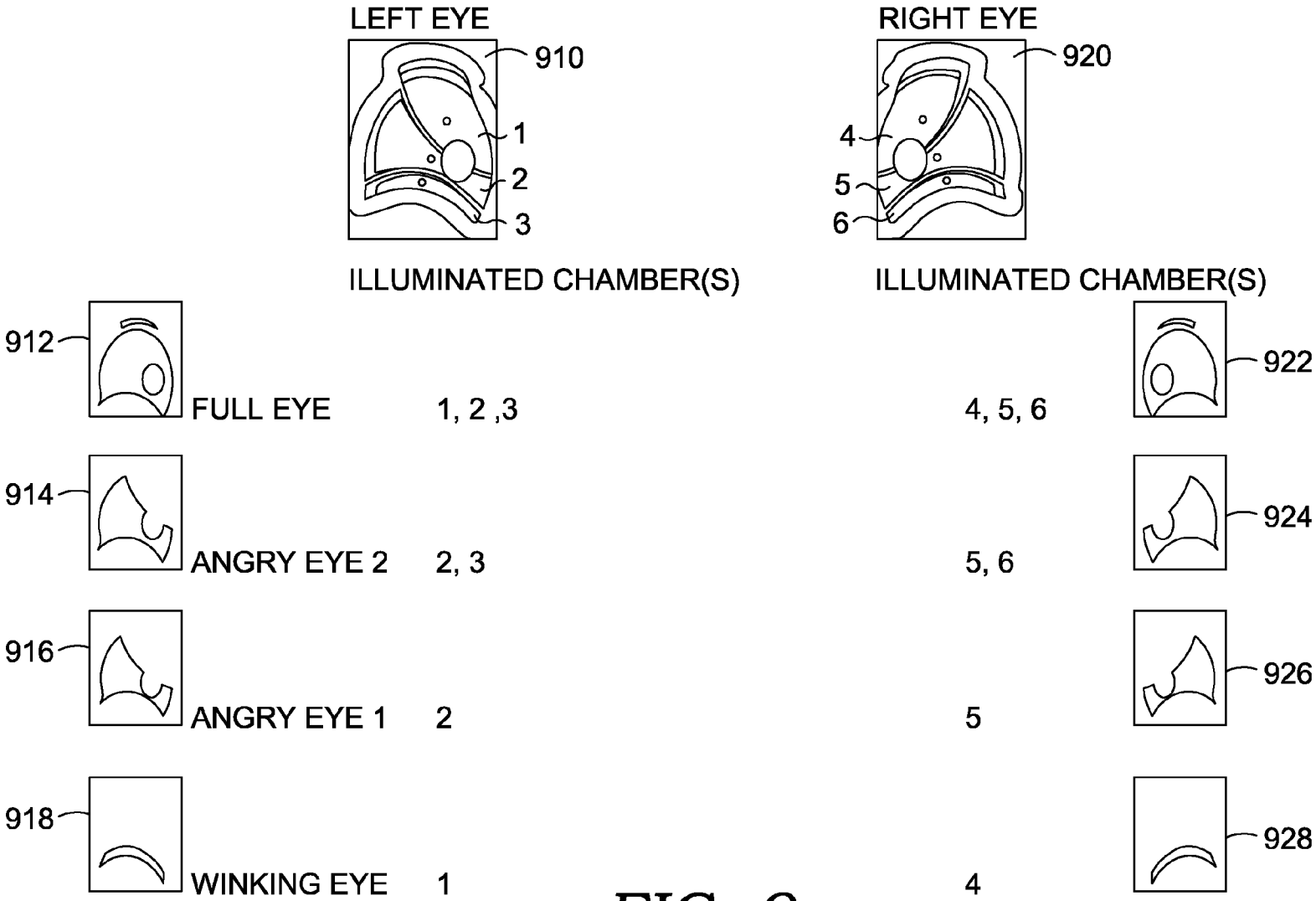
FIG. 9 depicts illuminated chambers for specific eye types, in accordance with an embodiment of the present invention.

FIG. 9 depicts the left eye light chambers 910 and the right eye light chambers 920. By lighting the LEDs within the light chambers, the left and right eyes can express a full eye 912, 922; an angry eye 914, 924, 916, 926; and a winking eye 918, 928.

Figure 10:
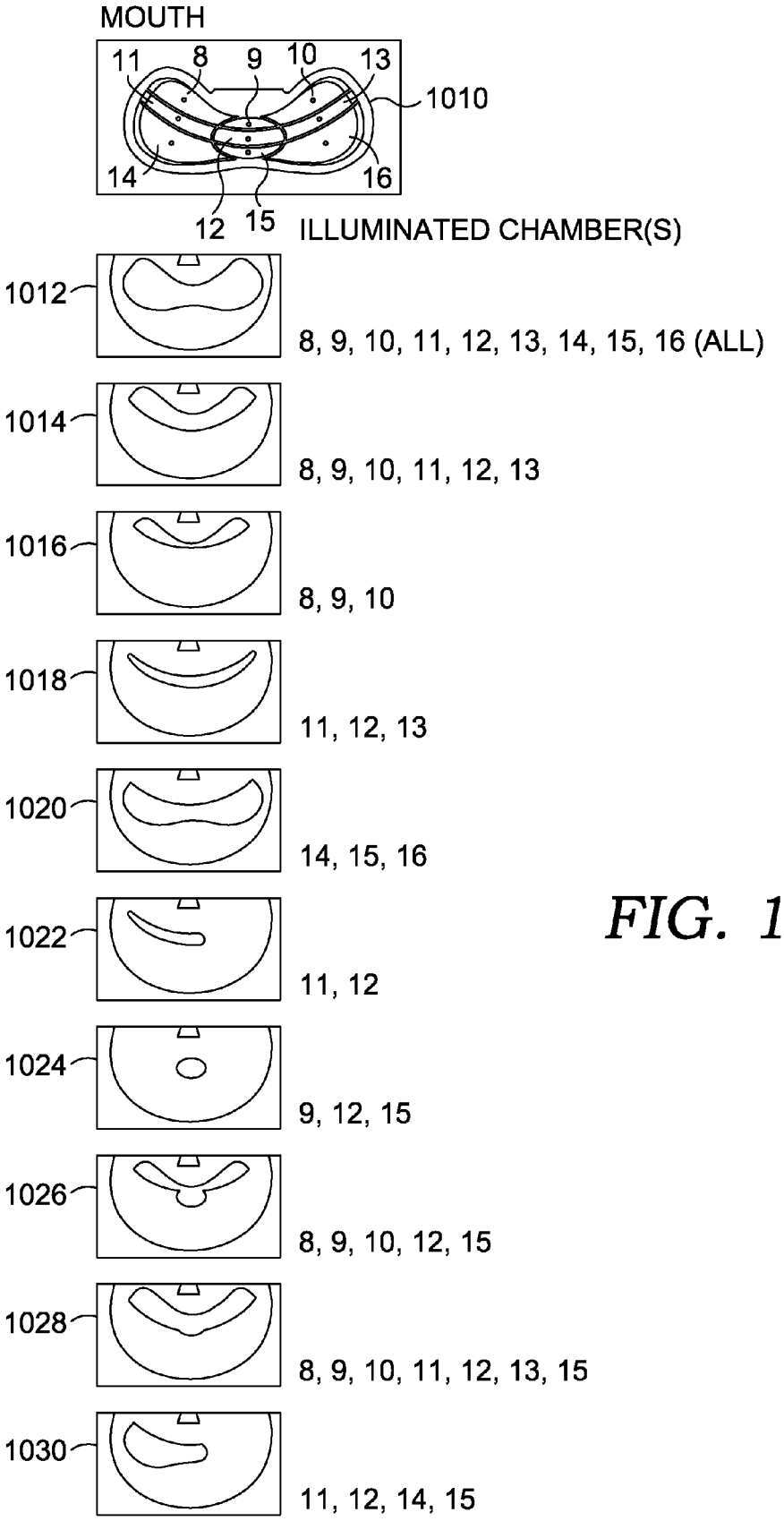
FIG. 10 depicts illuminated chambers for specific mouth types, in accordance with an embodiment of the present invention.
Figure 11:
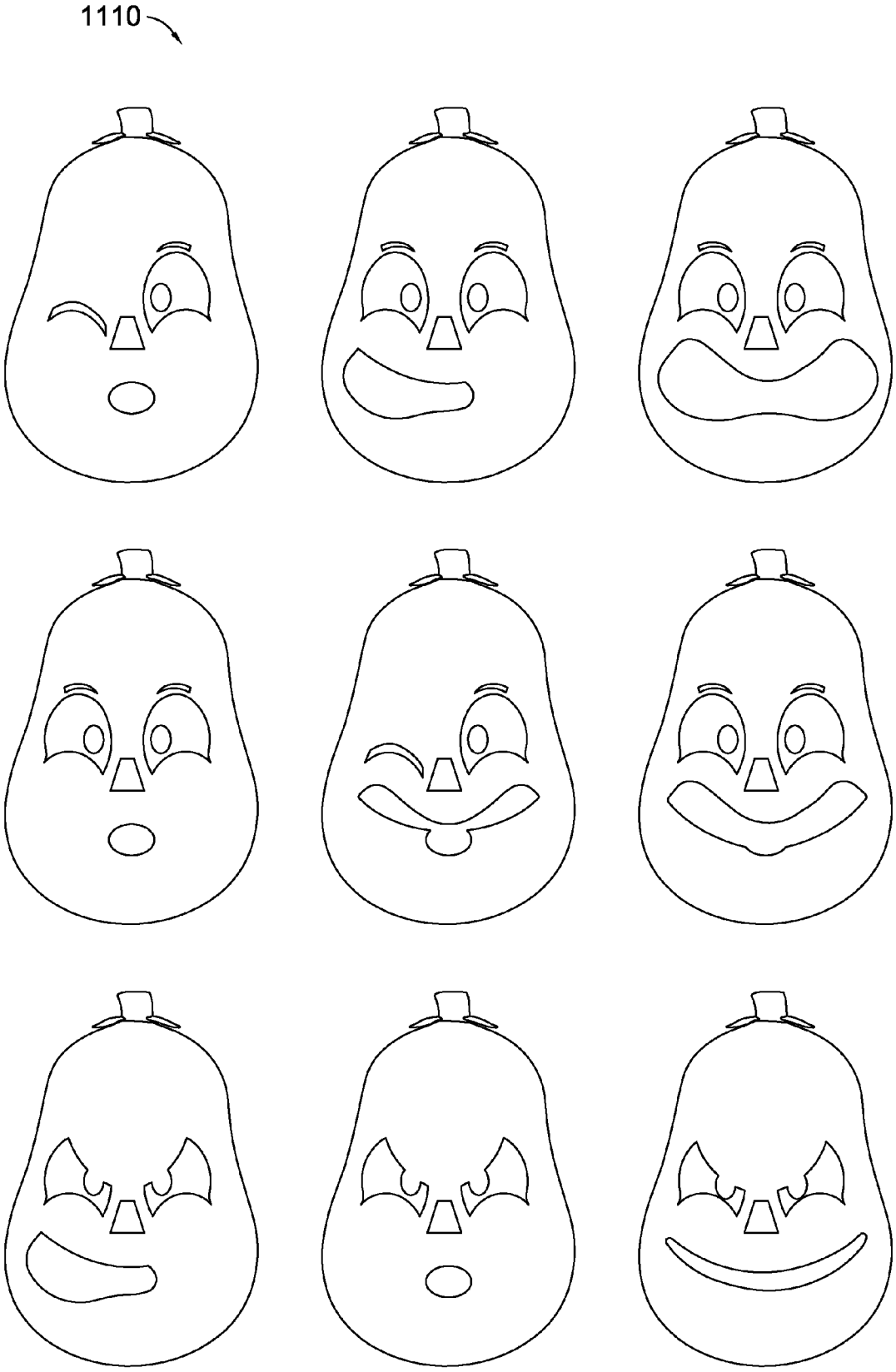
FIGS. 11-12 depict some jack-o'-lantern expressions using specific eye types, and specific mouth types, in accordance with an embodiment of the present invention.
Figure 12:
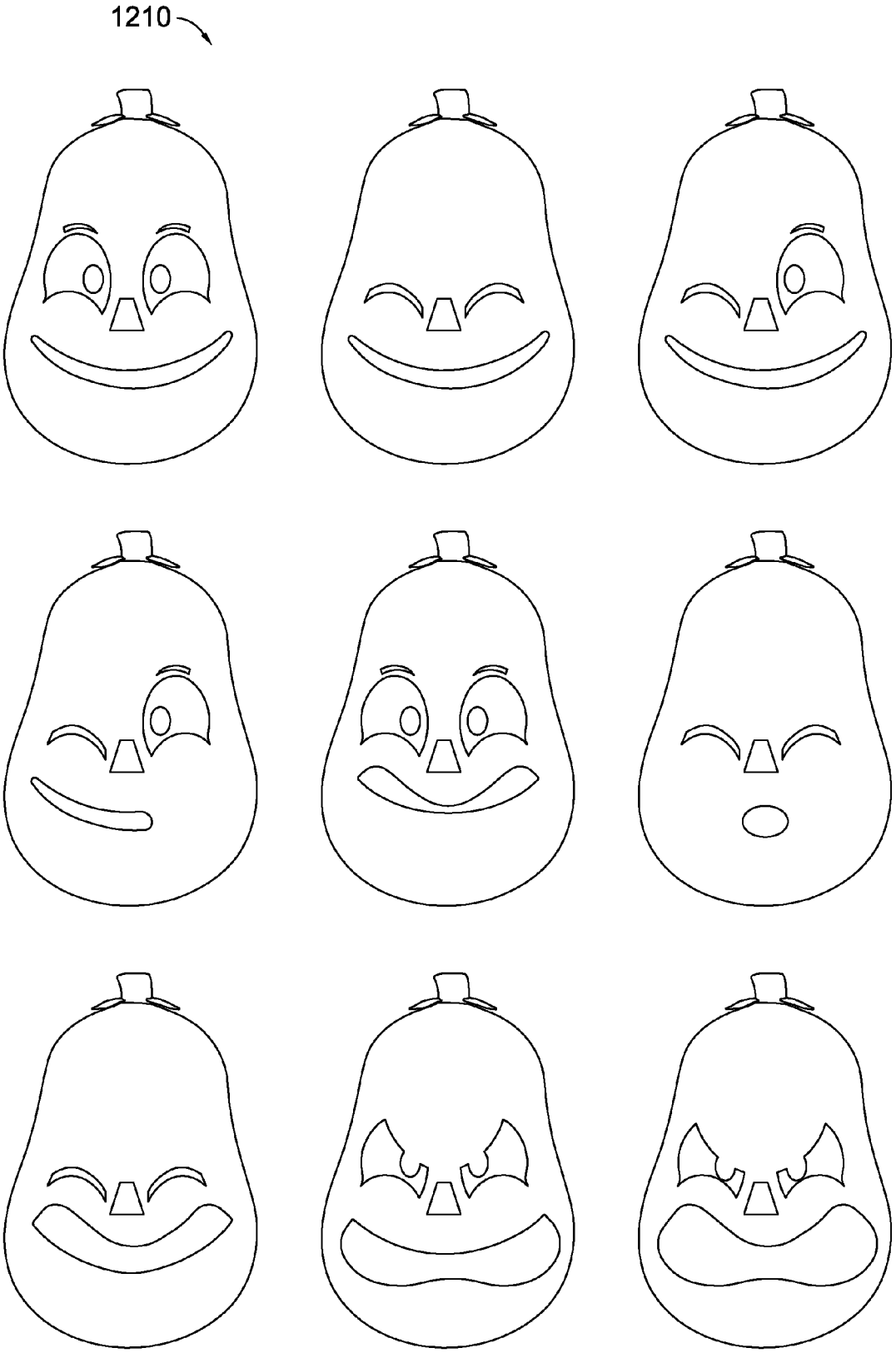

FIG. 10 depicts a wide range of mouth expressions 1012-1030 that could be achieved with mouth light chambers 1010. A full smile 1012 is generated by lighting all of the light chambers. A different smile 1014 is generated by lighting chambers 8, 9, 10, 11, 12, and 13. A slim smile 1016 is generated by lighting chambers 8, 9, and 10. A crescent moon-shaped smile 1018 is created by illuminating chambers 11, 12, and 13. A large grin 1020 is formed by illuminating chambers 14, 15, and 16. A half smile 1022 is created by illuminating chambers 11 and 12. An "oh" shaped smile 1024 is created by illuminating central chambers 9, 12, and 15. Mouth expression 1026 is created by illuminating chambers 8, 9, 10, 12, and 15. Expression 1028 is created by illuminating chambers 8, 9, 10, 11, 12, 13, and 15. A large half smile 1030 is generated by lighting chambers 11, 12, 14, and 15. By combining the left and right eye expressions, and the mouth expressions, the jack-o'-lantern can exhibit a full range of expressions 1110 and 1210 as shown in FIGS. 11-12.

Figure 13:
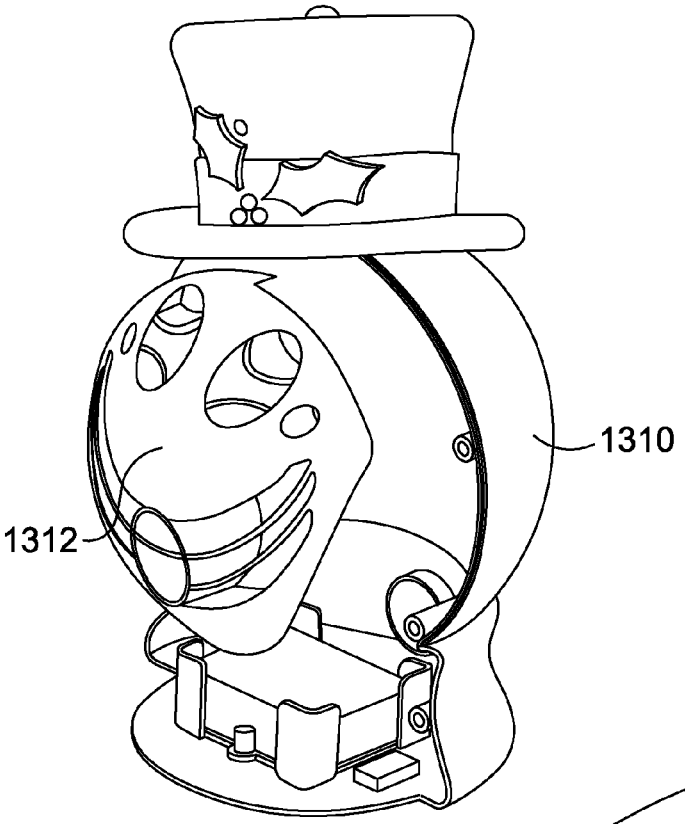
FIGS. 13-14 depict a cross-section of a snowman and a light chamber construction, in accordance with an embodiment of the present invention.
Figure 14:
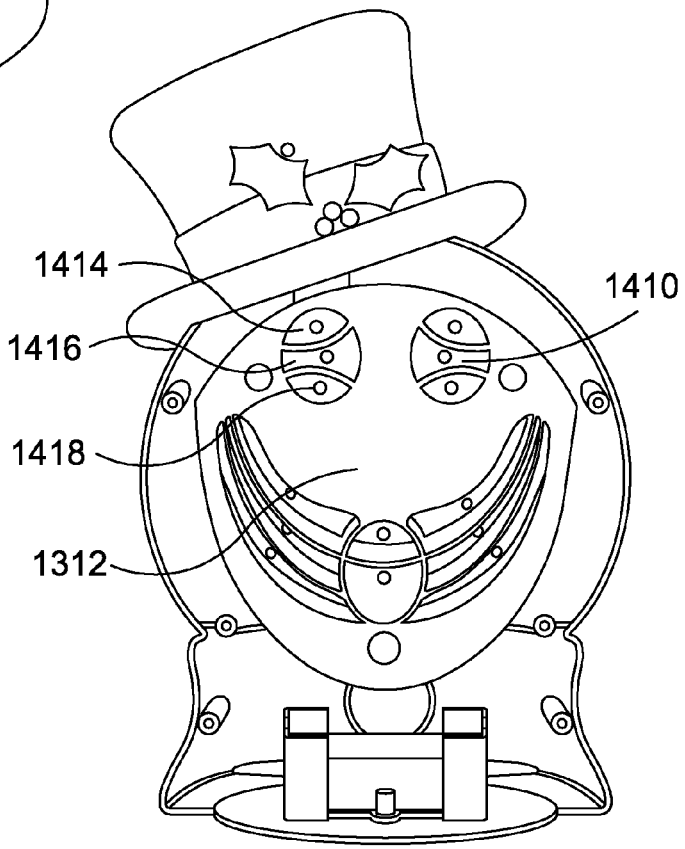
Figure 15:
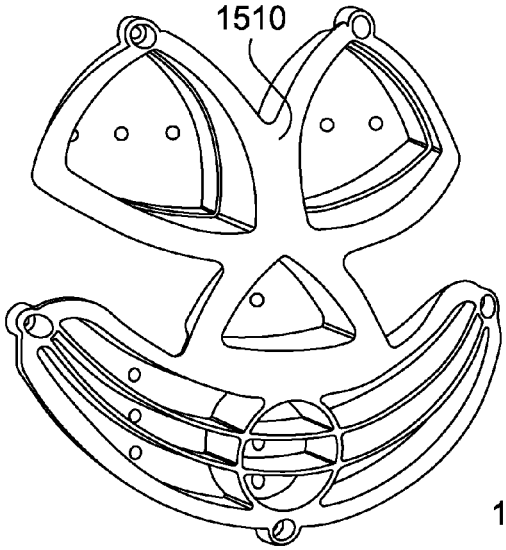
FIGS. 15-17 depict a light chamber construction for a face, in accordance with an embodiment of the present invention.
Figure 16:
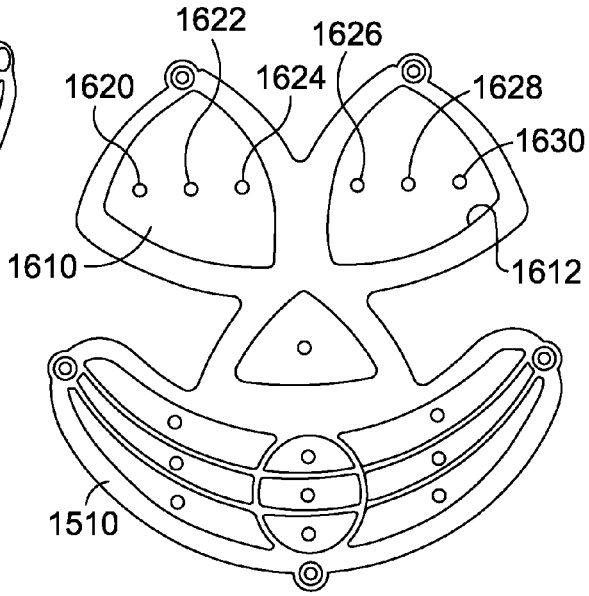
Figure 17:
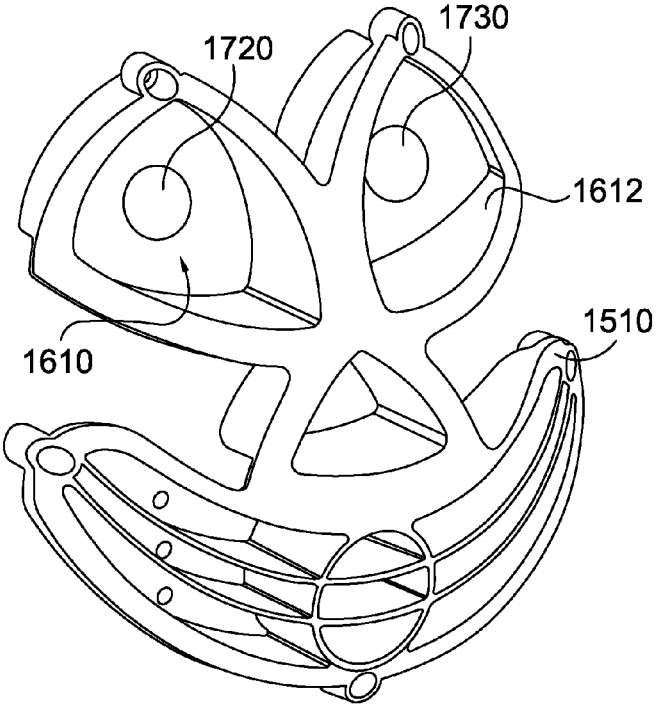

Referring to FIGS. 13-14, similar to the jack-o'-lantern concept above, the lighted chambers concept can be used to illuminate other items, such as the snowman head. The snowman includes a translucent head 1310, which by itself defines, or which cooperates with an opaque base to define, a hollow chamber into which is received the electronics necessary to create the animated illumination effects. When the lights are off, the snowman looks like a simple figurine. When activated, lights inside the snowman are selectively activated to illuminate various chambers. The illumination passes through the wall of the globe that is the snowman's head and is visible on the exterior surface of the snowman in a shape corresponding to the illuminated chamber.

FIG. 13 depicts a cross-section that illustrates the relationship between the illumination chassis 1312 adjacent to the inner surface of the globe wall. It also illustrates the various individual chambers and the apertures in the rear wall of each individual light chamber. Multiple chambers may be illuminated at one time to create an "all on" appearance that creates and/or complements facial features of the snowman (See FIG. 14). By selectively illuminating select chambers, different facial expressions can be projected on the exterior surface of the snowman's head.

In FIG. 14, half of the translucent outer wall of the globe that is the snowman's head has been removed to reveal the light chassis construction 1312. As can be seen in FIG. 14, the light chamber construction can be a unitary molded chassis 1312 that resembles a mask with a plurality of individual light chambers. For example, each of the eyes are divided into three light chambers (1414, 1416, and 1418), while the mouth is divided into eight light chambers, each of which can be selectively activated and has its own LED (1410 is an exemplary LED) positioned in or adjacent to an aperture in the rear wall of each chamber. By illuminating various chambers, different shapes of eyes and mouths are projected. In sequence, especially when activated in conjunction with spoken audio, the face of the snowman becomes animated and "comes to life," appearing to talk or sing.

In an embodiment (FIGS. 15-19), lights and shadows are used to turn an ordinary appearing artificial pumpkin into an animated jack-o'-lantern. The jack-o'-lantern of FIGS. 15-19 is similar to the Jack-o'-lantern of FIG. 8, but a different eye design with three light sources within a single light chamber is shown in FIGS. 15-19. The outer shell of the jack-o'-lantern 1510 is translucent, but not transparent. The design includes eye, nose, and mouth shapes common with a jack-o'-lantern 1510. When someone approaches the pumpkin, a motion detector senses movement and activates electronics inside the pumpkin to turn it into an animated jack-o'-lantern. Embodiments are not limited to user with a motion detector. A push button, automatic controller, or some other mechanism may activate the electronics. As can be seen from FIGS. 15 and 17, the light chambers are three-dimensional.

The electronics in the jack-o'-lantern 1510 include a plurality of LEDs (1620, 1622, 1624, 1626, 1628, and 1630) that shine on an inner wall of the outer shell of the pumpkin. Three LEDs are within a light chamber 1610 and three LEDs are within light chamber 1612. Embodiments are not limited to use with three light sources per chamber. For example, five light sources could be included in each chamber with one additional light source above LED 1622 and one below. As explained below, the additional lights above and below the central light source could be used to create an effect of the pupils moving up and down. The electronics also include a memory (which contains audio files and light programs), a battery, and a speaker.

The interior of the pumpkin also includes an illumination chassis with a number of light chambers (e.g., 1610 and 1612) associated with one or more of the LEDs. The chambers work to constrain light from the LED and direct it to the outer wall of the jack-o'-lantern 1510 in a shape desired to be illuminated. For example, the light chambers for the eyes are triangular in shape and prevent light inside the jack-o'-lantern 1510 from bleeding outside of the desired triangular shape. The light chambers for the eyes also include an opaque obstruction 1720 and 1730 positioned between the three lights and the inner surface of the jack-o'-lantern's 1510 shell. The obstructions 1720 and 1730 include a design or shape that is opaque to prevent light from passing through the obstruction thereby casting a shadow on the inner wall of the pumpkin. The shadow, in turn, provides a dark shape in the otherwise lit region associated with the light chamber. In this embodiment, the opaque design on the film represents a pupil for the eye.

The eye chamber 1610 contains opaque obstruction 1720 that is placed in front of the LEDs. The eye chamber 1612 contains opaque obstruction 1730 that is placed in front of the LEDs. Each opaque eyeball casts a shadow onto the outer shell of the pumpkin when back-lit by LEDs. By changing which of the three LEDs turns on behind the transparent film, the shadow from the eyeball can appear in left side, center, or right side of the lighted eye. The light chamber for the eye includes three LEDs spaced laterally there along. By changing which light is lit, the program can change where the shadow of the pupil is positioned in the eye illumination area, thereby giving the appearance that the eyes of the jack-o'-lantern are moving.

There are several different eye movements that can be achieved: blinking (turning both eyes off briefly and then back on; winking (turning one eye off briefly and then back on while other eye stays on); shifting (moving eyes left and right in a synchronized fashion); crossing (moving eyes toward and away from each other). FIG. 18 illustrates eyes moving left and right in a synchronized fashion. The image of the eyes and mouth is shown as the illumination chassis and lighting assembly would appear from the exterior of the jack-o'-lantern 1510. The mouth and nose are shown with a static expression created by lighting a series of lights within chambers associated with the nose and mouth. It is possible for the expressions of the nose and mouth the change in synchronization with the eyes, but that is not shown in this example for the sake of simplicity. Though not shown, adding additional lights above and below a central light in the light chamber allows an up and down effect to be created that is similar to the side-to-side effect described above.

The mouth region includes a plurality of light chambers that allow or provide for illumination of various parts of the mouth region. This also allows the program to create movements of the mouth that appear on the side of the pumpkin, which animates the jack-o'-lantern's appearance. The lights can be timed to turn on and off in combination with recorded audio to give the appearance that the jack-o'-lantern has come to life and is talking to the person approaching that jack-o'-lantern. Lights can also be timed to turn on and off without audio. For example, a wink expression could be provided without synchronized audio. While this embodiment has been described with a single chamber and film for the eyes and multiple light chambers for the mouth, either method can be used in any of the locations (i.e., one can use multiple chambers for the eyes).

Expression 1810 shows LED light sources turned on to create a pupil-shaped shadow 1820 in the left corner of the left eye 1821 and a pupil-shaped shadow 1822 in the left corner of the right eye 1822. This effect may be created by illuminating LED 1624 and LED 1630.

Expression 1812 shows LED light sources turned on to create a pupil-shaped shadow 1830 in the center of the left eye 1821 and a pupil-shaped shadow 1832 in the center of the right eye 1822. This effect may be created by illuminating LED 1622 and LED 1628.

Expression 1814 shows LED light sources turned on to create a pupil-shaped shadow 1840 in the right corner of the left eye 1821 and a pupil-shaped shadow 1842 in the right corner of the right eye 1822. This effect may be created by illuminating LED 1620 and LED 1626. In combination, expression 1810, 1812, and 1814 create an animation of the eyes sweeping back and forth in synchronization.

Turning now to FIG. 19, a pair of expressions 1816 and 1818 are shown to create an eye crossing animation. Expression 1816 shows LED light sources turned on to create a pupil-shaped shadow 1850 in the right corner of the left eye 1821 and a pupil-shaped shadow 1852 in the left corner of the right eye 1822. This effect may be created by illuminating LED 1620 and LED 1630. Expression 1818 shows LED light sources turned on to create a pupil-shaped shadow 1860 in the left corner of the left eye 1821 and a pupil-shaped shadow 1862 in the right corner of the right eye 1822. This effect may be created by illuminating LED 1624 and LED 1626. Programming is included within the jack-o'-lantern 1510 to synchronize activation of the LEDs required to create these expressions.

Figure 20:
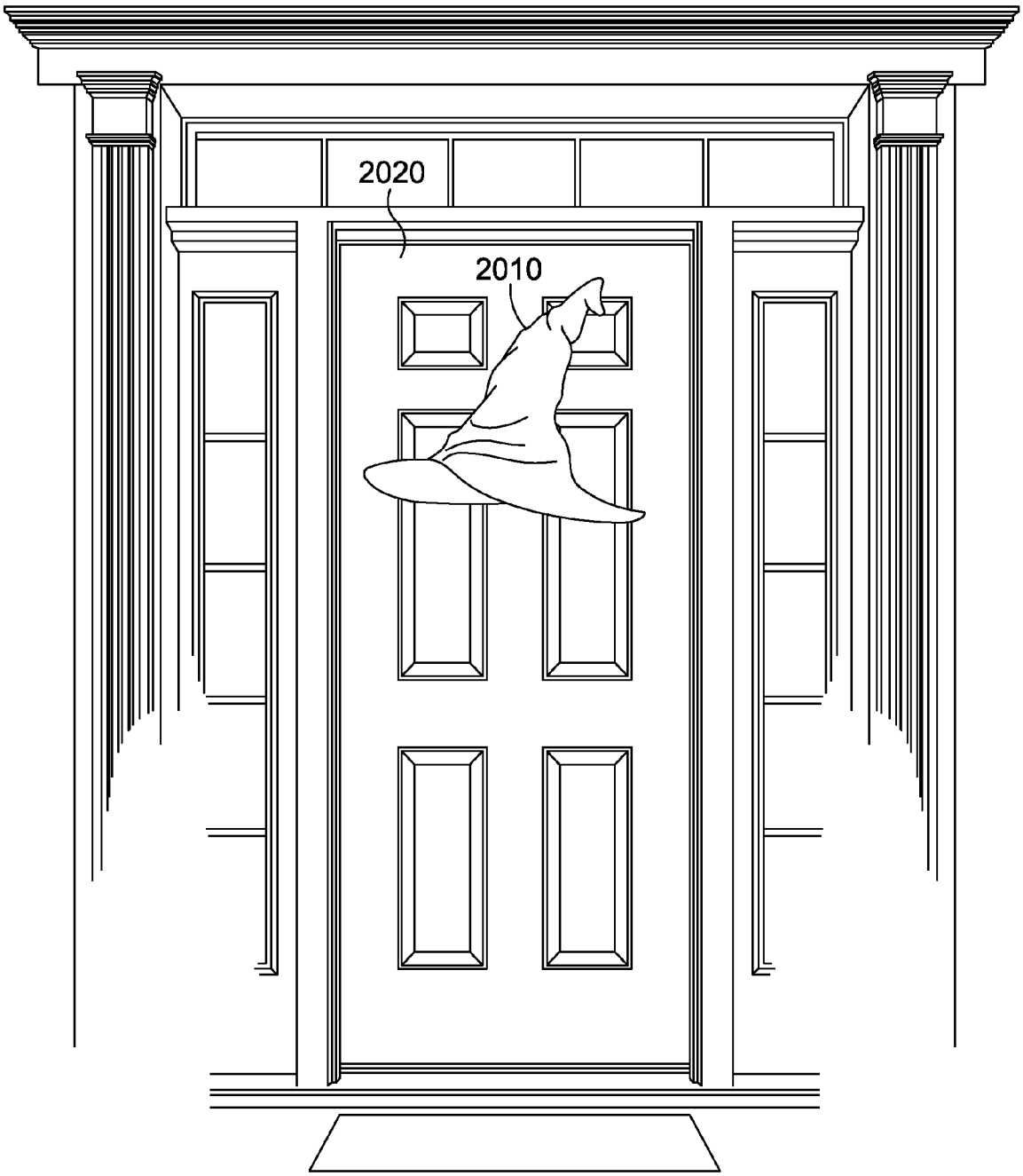
FIG. 20 depicts a witch's hat hung from a door, in accordance with an embodiment of the present invention.
Figure 21:
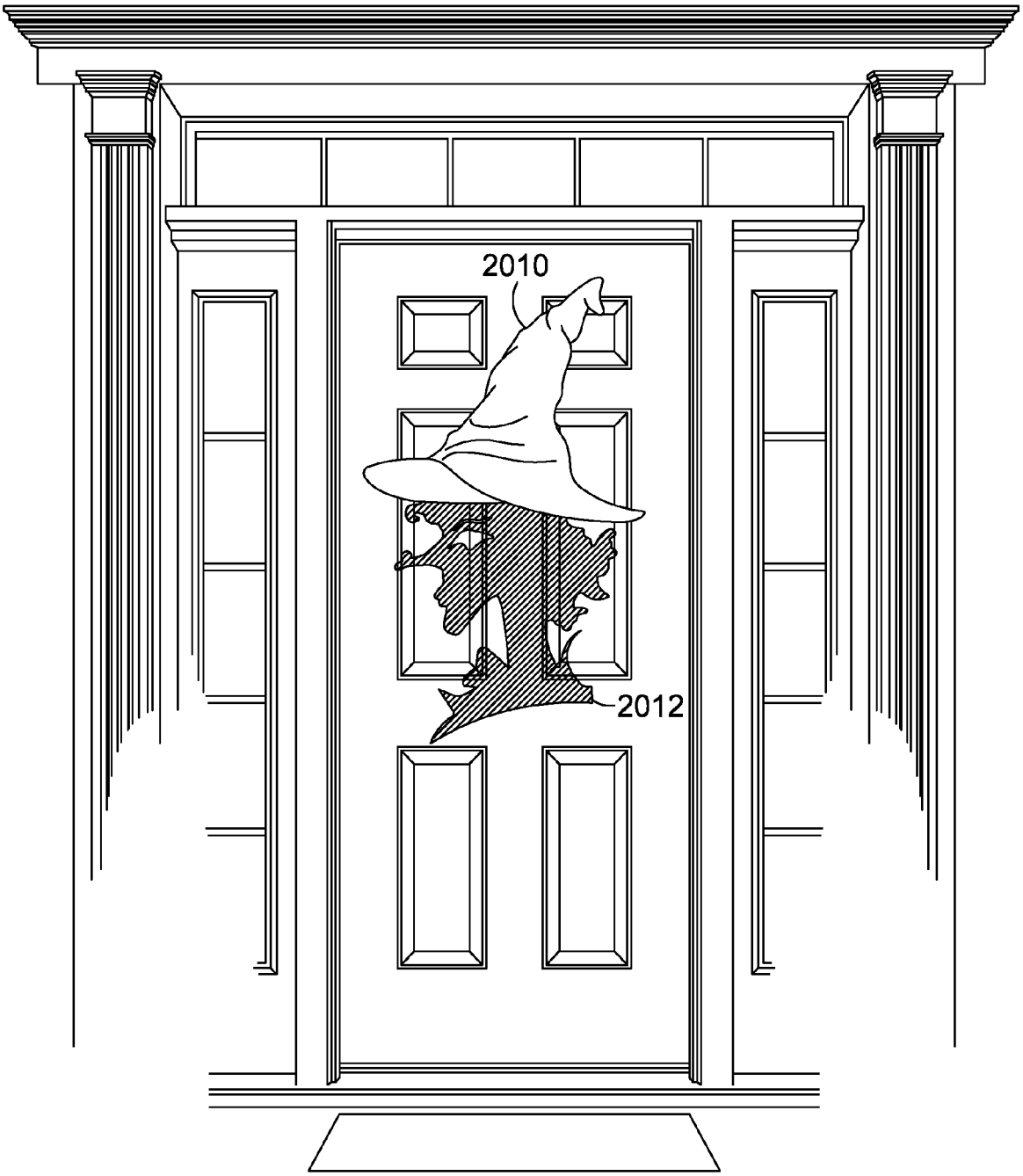
FIG. 21 depicts a witch's hat projecting a shadow of a witch's face on a door, in accordance with an embodiment of the present invention.

In an embodiment of the invention, the light and shadow effects created by the light are created outside of the object that contains the electronics and in an adjacent location to provide an illuminated image that cooperates with the object. In one embodiment, the object is a holiday decoration. Holiday decorations may include decorations for such holidays as the Fourth of July, Christmas, Easter, Hanukkah, Memorial Day, Halloween, Labor Day, Thanksgiving, and the like. As used herein, holiday decorations may also include decorations associated with special events such as anniversaries, birthdays, weddings, baby showers, and the like. In FIG. 20, the holiday object is a witch's hat 2010 More particularly, the object 2010 is half of a witch's hat that is to be hung on a vertical surface, such as a door of a house 2020 (See FIG. 20). As shown in FIG. 21, the complimentary illuminated image 2012 is the face of a witch.

Figure 22:
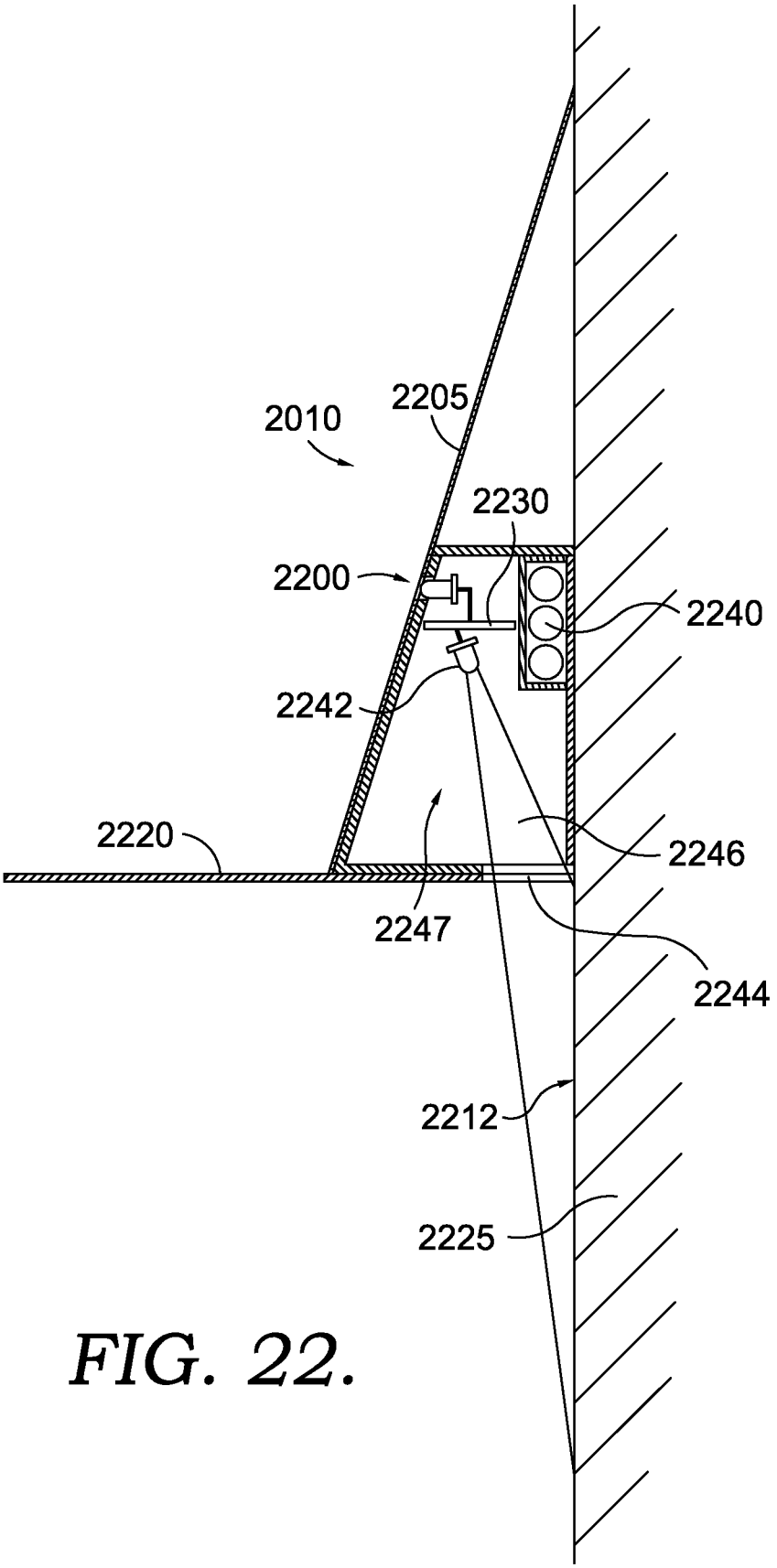
FIG. 22 depicts a motion sensor and project mounted within a witch's hat, hung on a surface, in accordance with an embodiment of the present invention.
Figure 23:
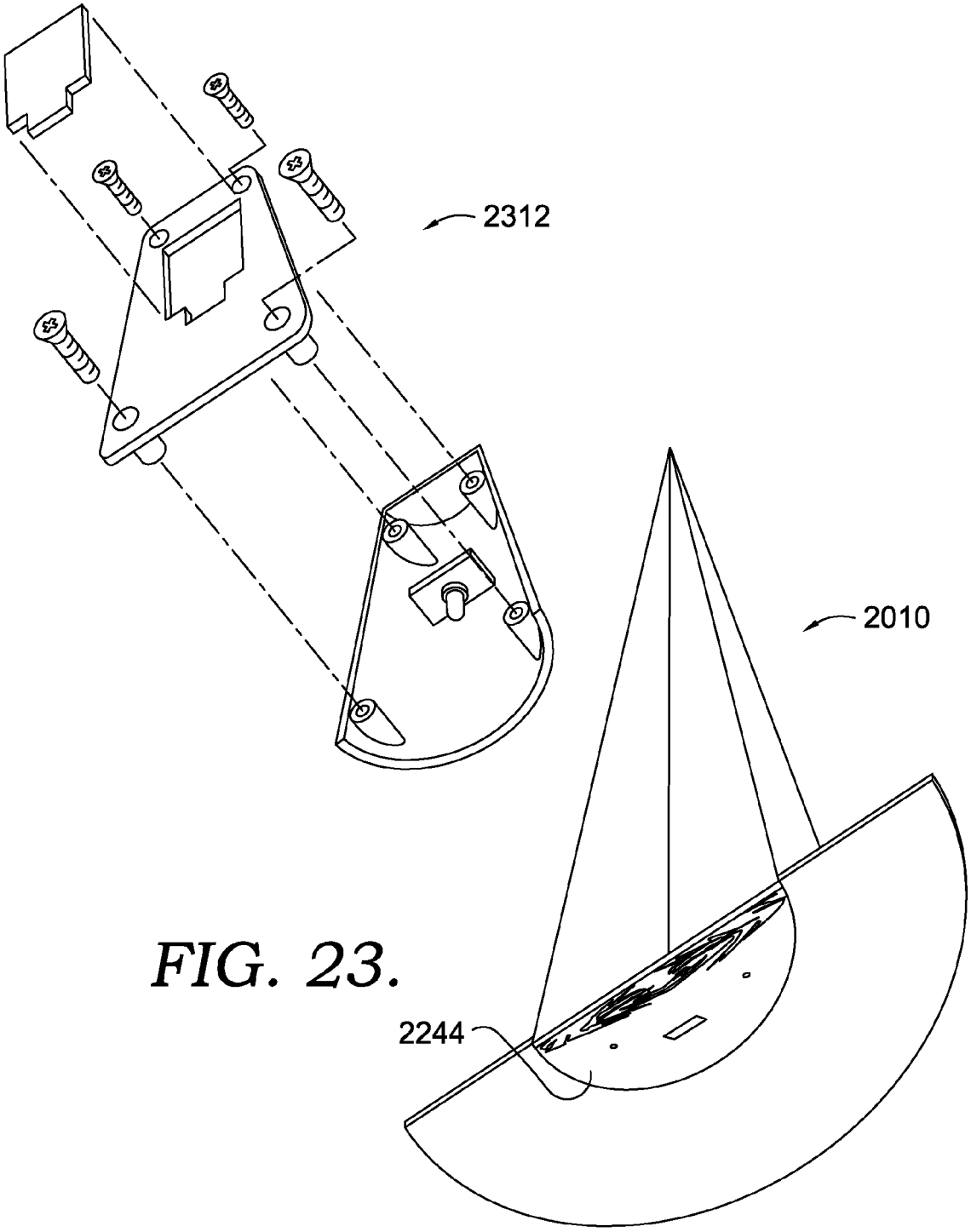
FIGS. 23-25 depict a housing for a projector that can be mounted in a witch's hat, in accordance with an embodiment of the present invention.

Turning now to FIG. 22, the object 2010 may have a rest state that gives a normal, unanimated appearance. When a person approaches the object, a motion detector 2200 senses the same and activates the electronics inside the witch's hat to animate the object 2010. In one embodiment, the animation 2212 appears adjacent the object 2010, and compliments the object. The object 2010 has the exterior housing 2205 that forms an interior of the housing 2247. Decorative objects, such as a hat brim 2220 may be attached to the exterior housing 2205. The interior 2247 of the object 2010 houses electronics that create a shadow animation. Electronics may be powered by batteries 2240 or some other power source. A controller 2230 may receive a signal from a motion detector 2200, and audio command from a speaker (not shown) and turn on a light source 2242 in response. The light 2246 passes through a film 2244 that includes a disproportionate image that creates an appropriately apportioned image 2212 on the adjacent display surface 2225. The film 2244 covers an opening in the exterior housing 2205.

The film 2244 includes an image that has been manipulated to provide for a low profile projection of an image 2212 (e.g., a face) onto the vertical surface 2225 directly below the opening of the object 2010. The image on the film is distorted in order to produce the low profile projection of the image 2112. In that regards, the face is not readily visible or discernible in the film 2244. The low angle projection of light through the film casts a shadow that is stretched out to create an image 2112 of a face that appears normal (i.e., one that is not stretched or disproportioned).

Figure 24:
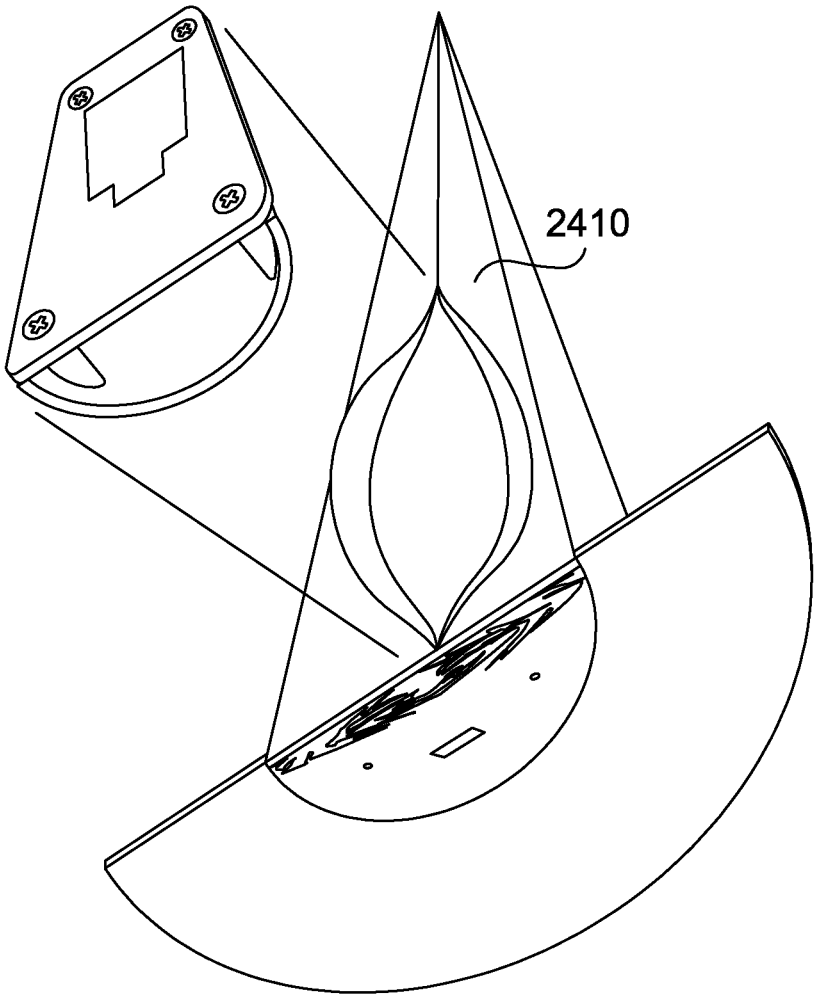

The electronics may be mounted in a housing 2312 within the object 2010 that includes one or more lights, a memory with sound recording stored therein, and a speaker for producing audio. The housing 2312 could be inserted into the object (See FIG. 24), such as a witch's hat 2410.

The activation of the electronics creates an illuminated image that cooperates with the object to animate the object. This unexpected illumination surprises the approaching person and brings the object to life in the eyes of the viewer. In an embodiment, the lights and shadows are of a jack-o'-lantern face and compliment the pumpkin-shaped object. In the embodiment, the lights and shadows are of a witch's face and compliment the witch's hat. Accordingly, the objects produce lights and shadows in a design that compliments or goes with the shape, design or theme of the object.

Figure 25:
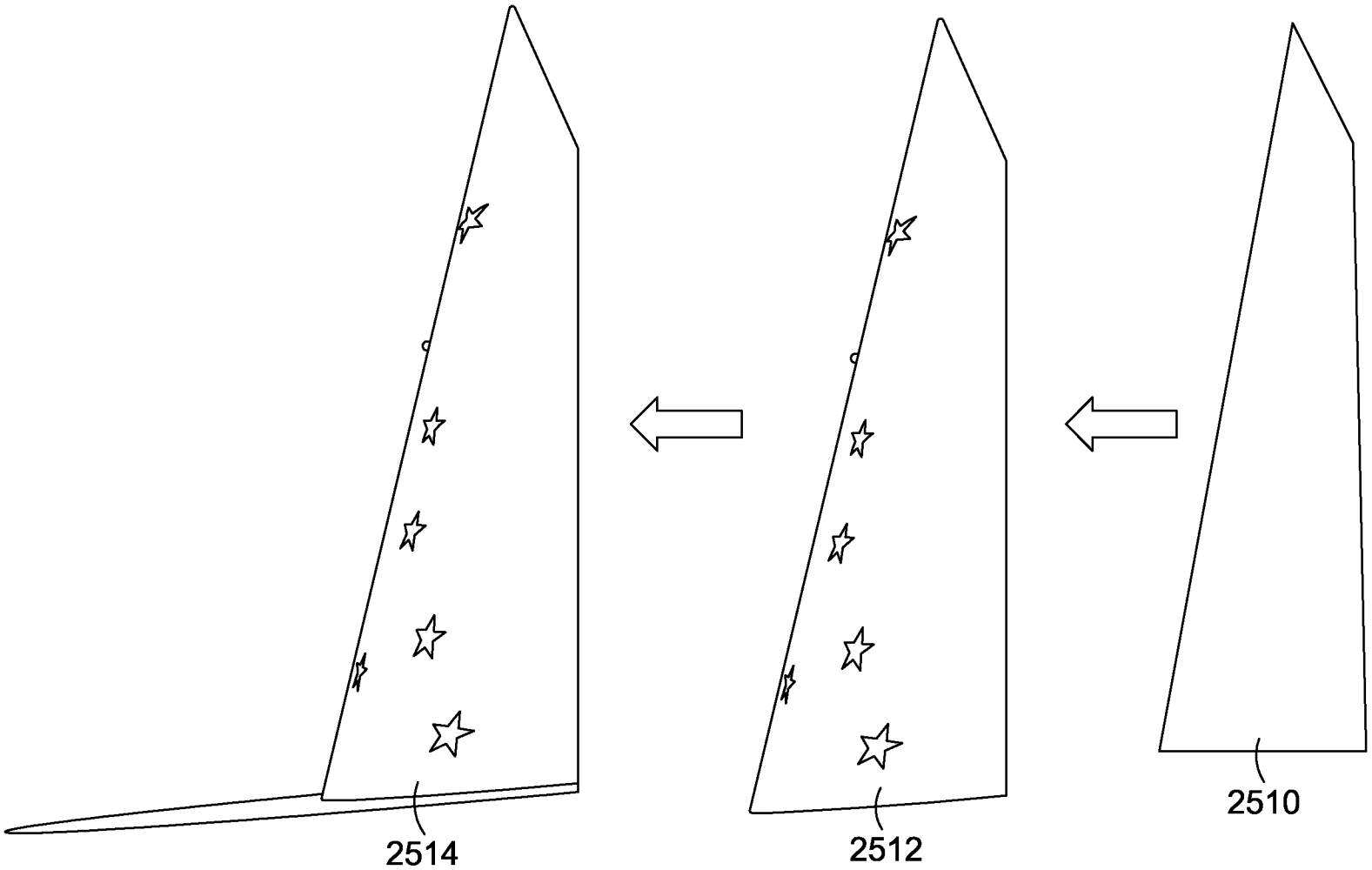
Figure 26:
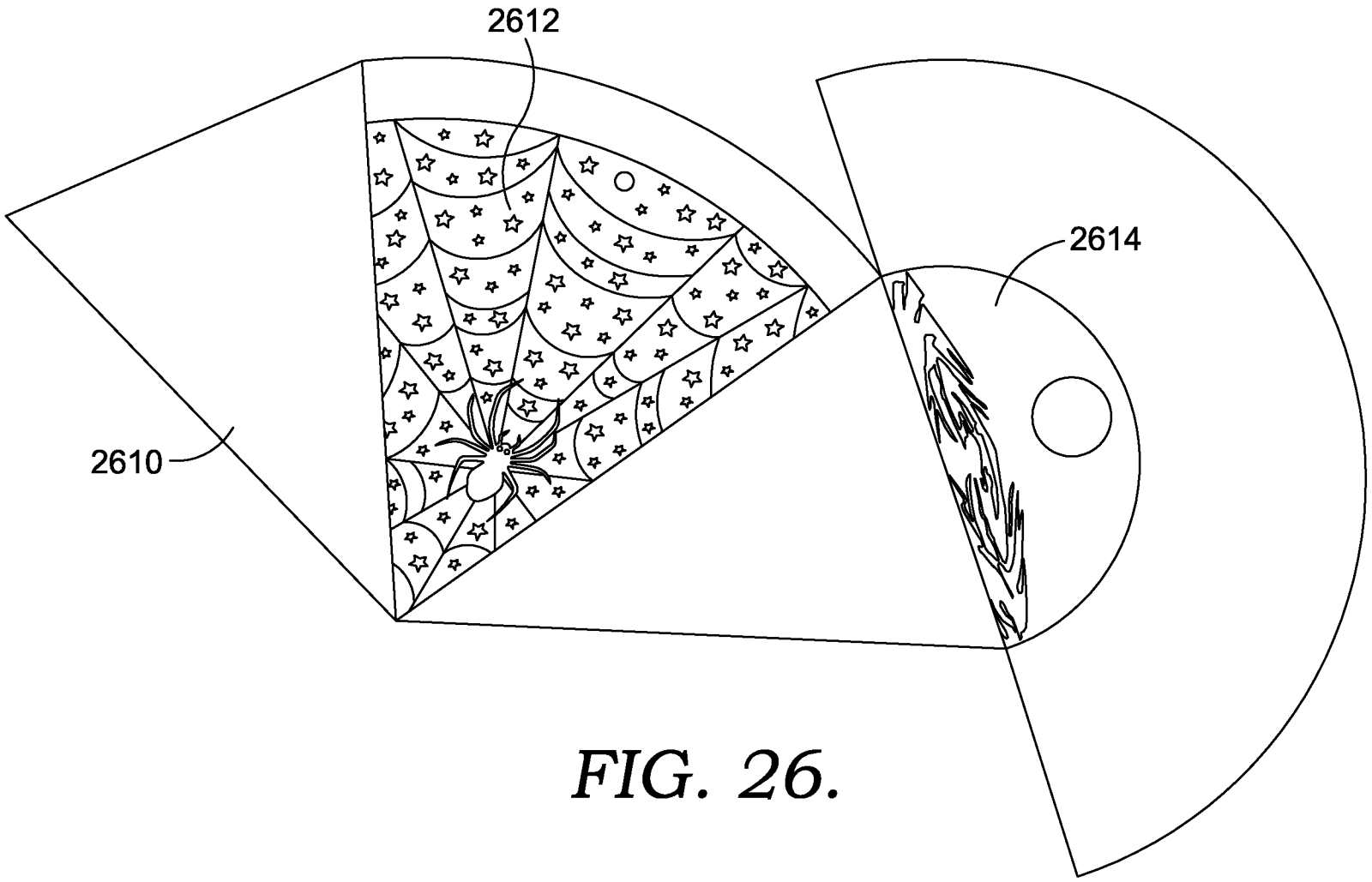
FIG. 26 depicts a construction of a witch's hat, in accordance with an embodiment of the present invention.
Figure 27:
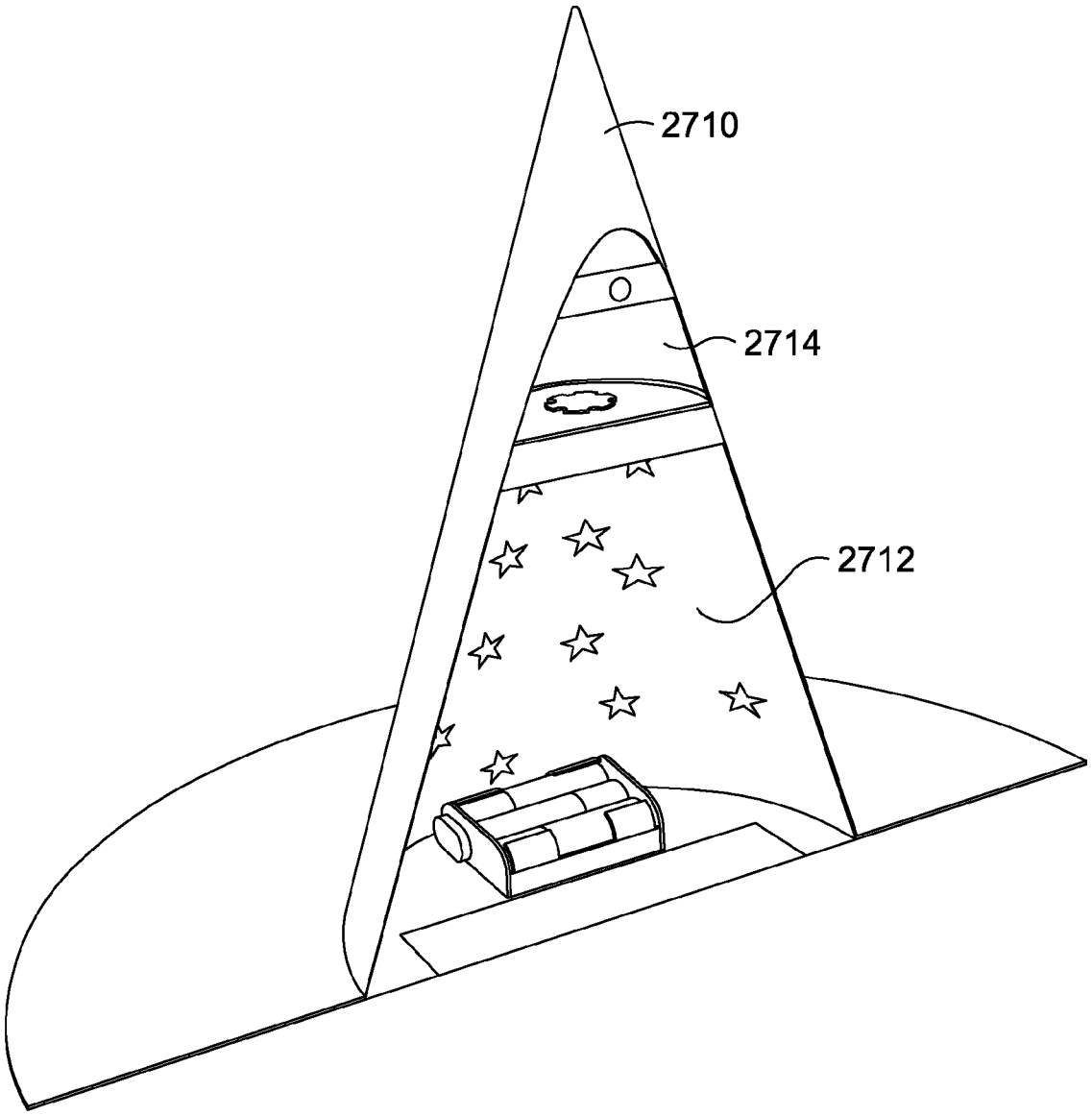
FIG. 27 depicts a die cut-out of a witch's hat, in accordance with an embodiment of the present invention.
Figure 28:
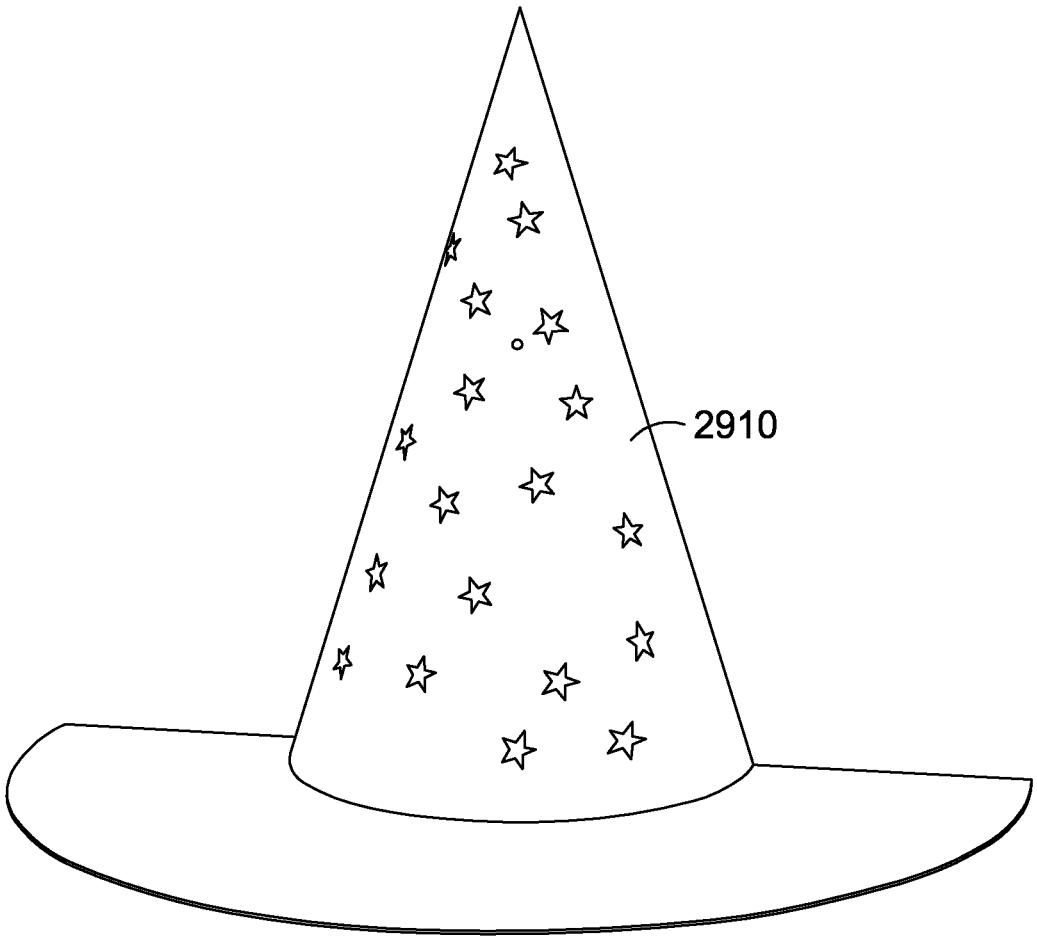
FIG. 28 depicts a rear view of a witch's hat, in accordance with an embodiment of the present invention.

Referring to FIGS. 25-28, the object could have decorative elements that are illuminated by an internal light source, such as LEDs. FIG. 25 depicts an assembly method for illuminated decorations. A clear, weather-resistant, plastic casing 2510 is painted with a decoration, such as stars, dropped out 2512. The assembled pieces resemble a hat with stars that can be illuminated 2514. FIG. 26 depicts a die cut-out 2610 for a witch's hat. The die cut-out 2610 has illuminated decorations 2612, and a projection film 2614. FIG. 27 depicts an assembled witch's hat 2710, from the back, with illuminated decorations 2712, and a cavity 2714 for the projection housing. FIG. 28 depicts the front view of an assembled witch's hat 2810.

Figure 29:
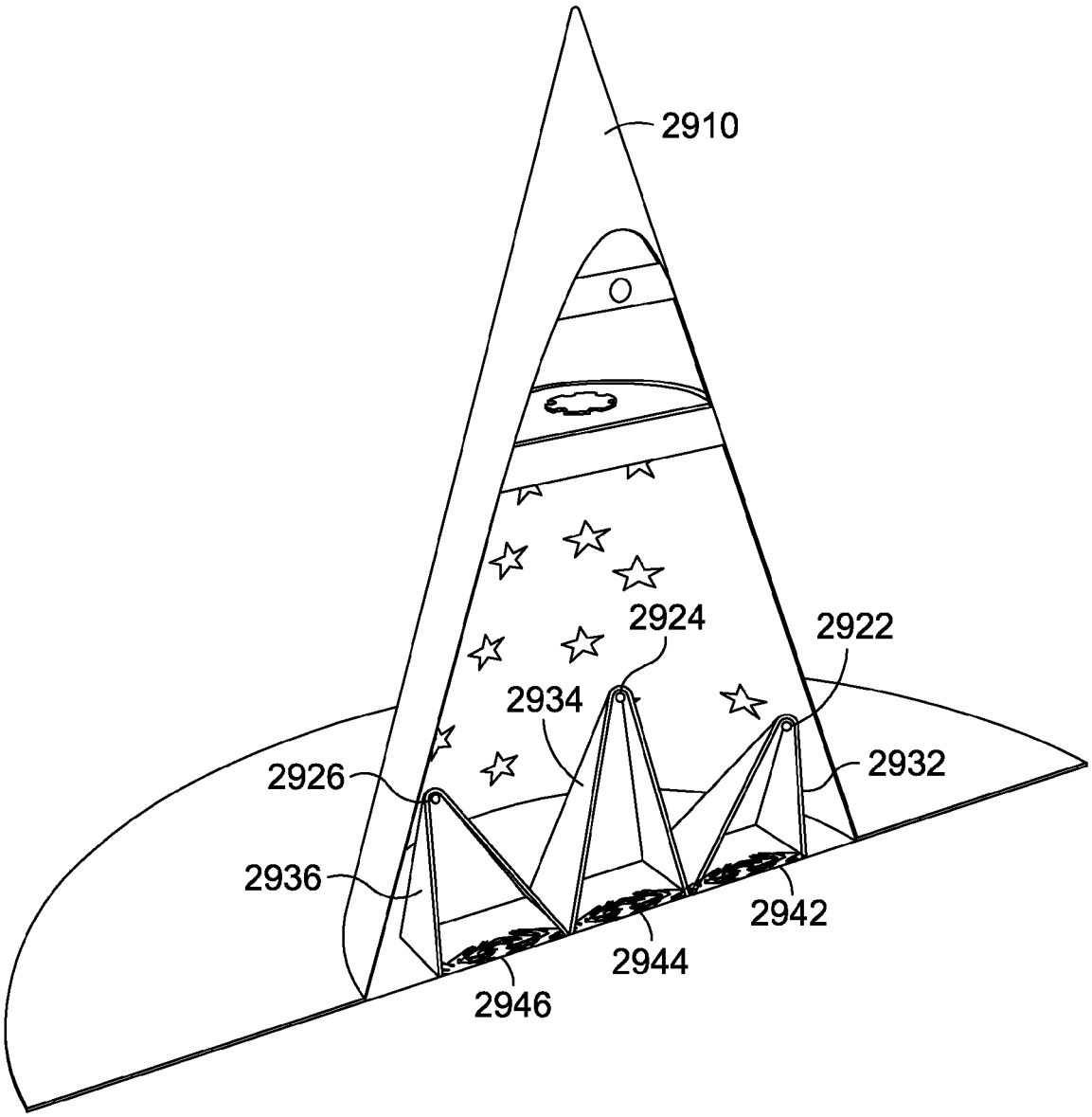
FIG. 29 depicts a witch's hat having multiple light sources, in accordance with an embodiment of the present invention.

Turning now to FIG. 29, a decorative object 2910 with multiple light projection chambers is shown, in accordance with an embodiment of the present invention. The decorative object 2910 may take the form of a witch's hat or other holiday decoration. As explained previously with reference to FIG. 20-28, the image or images projected by decorative object 2910 compliment the object. For example, a witch's head may be projected underneath a witch's hat. In one embodiment, the decorative object is a star and the projected image is a Christmas tree. The Christmas tree image is projected with an orientation to make the star appear attached to the Christmas tree as an ornament or tree topper.

Decorative object 2910 includes three light sources each associated with a light chamber and an image film used to create a shadow. The light sources include light source 2922, light source 2924, and light source 2926. Light source 2922 directs light into light chamber 2932. Light source 2924 directs light to light chamber 2934. And light source 2926 directs light into light chamber 2936. The light chambers may be formed of an opaque material that prevents light from escaping into adjacent chambers. The light chamber may have a top with an opening through which the light source is inserted to prevent light from escaping into the interior of the decorative object 2910 in contaminating other light chambers. The interior of the light chambers may be covered with a reflective material.

Figure 31:
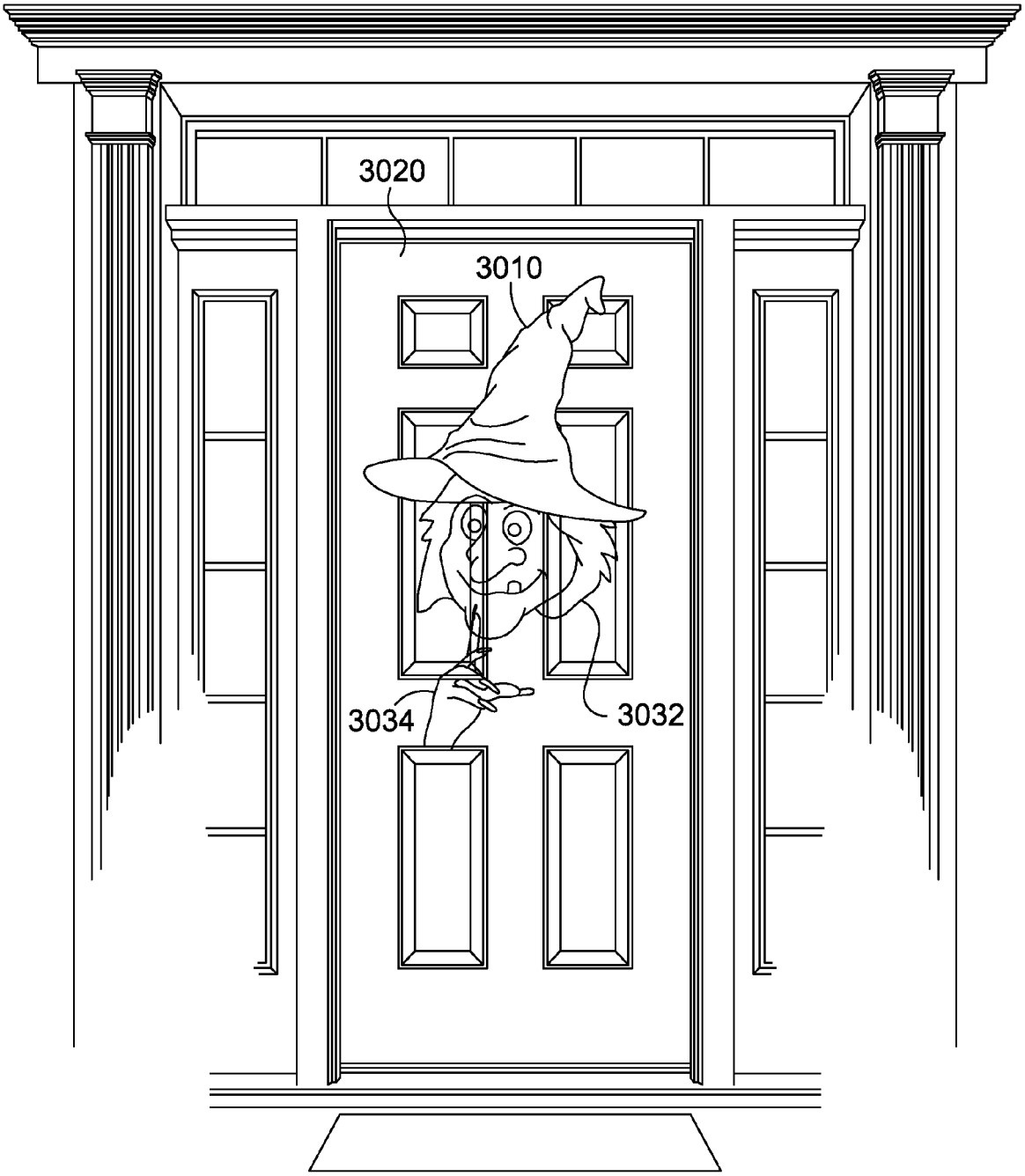
Figure 32:
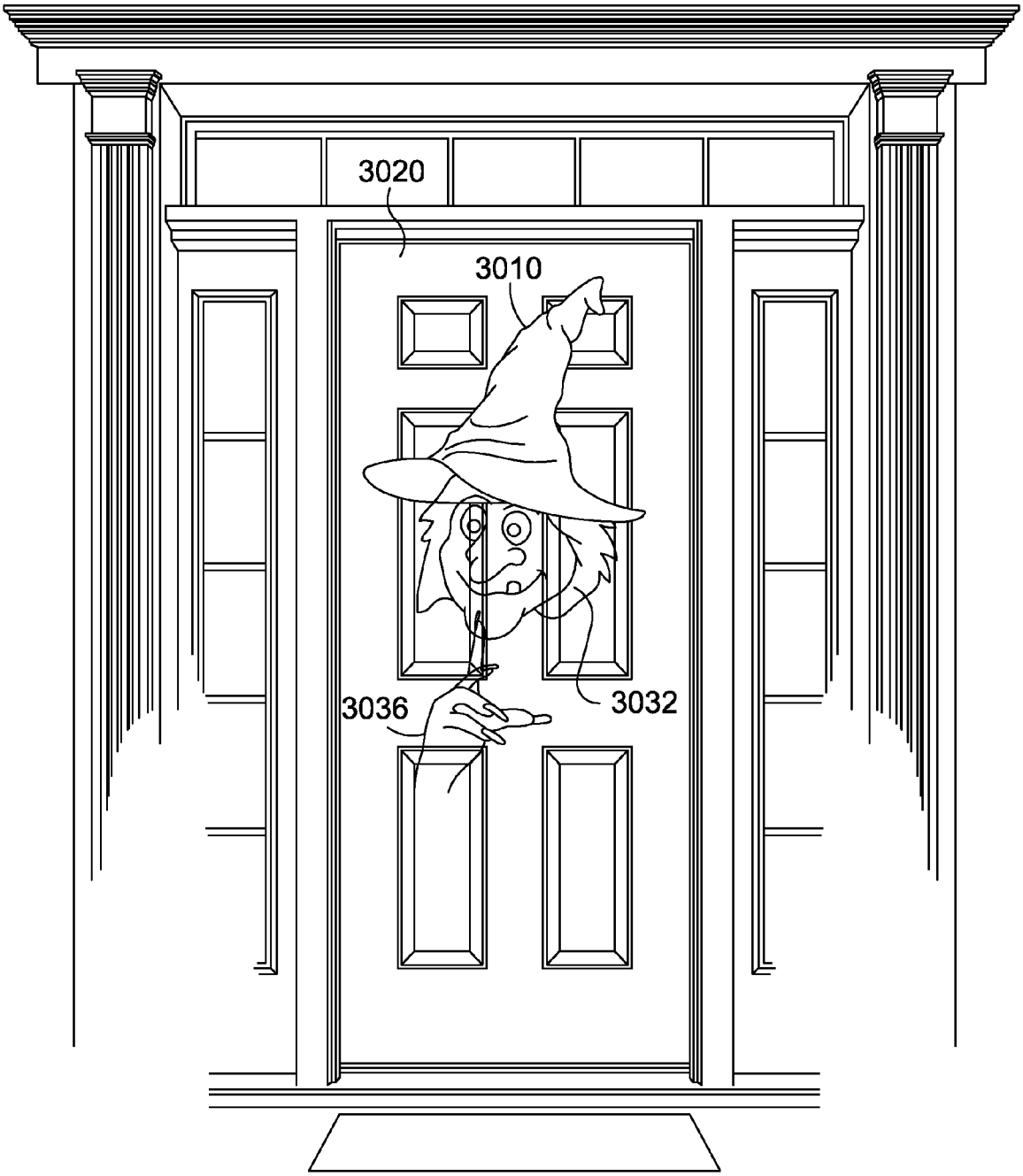

Light from light source 2922 shines through the film 2942 to create a shadow image on an adjacent surface. Light from light source 2924 shines through the film 2944 to create a shadow image on the adjacent surface. Light from light source 2926 shines through the film 2946 to create a shadow image. The shadow images created by film 2942, 2944 and 2946 may each be different. In one embodiment, the lights are synchronized to turn on and off to create a sequence of images. The sequence of images may create the illusion of movement or change within the shadow image. For example, a witch's image could blink or her eyes move. Exemplary animation is shown in FIGS. 30 to 32.

Figure 30:
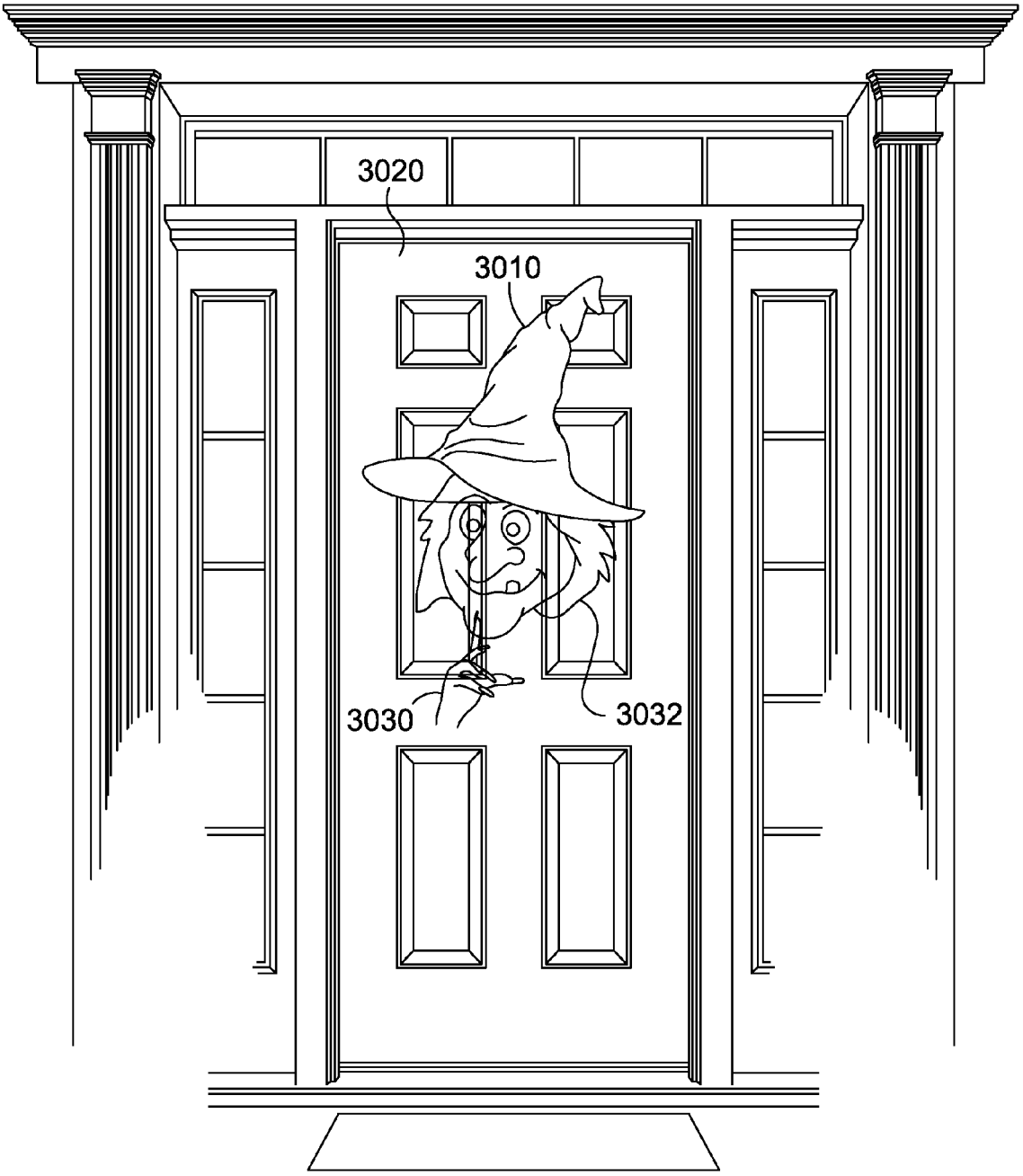
FIGS. 30-32 depict an animation sequence, in accordance with an embodiment of the present invention.

FIG. 30 shows a decorative object 3010 hanging on a door 3020. The door 3020 forms the projection surface in this example. An image of a witch's head 3030 is projected underneath the decorative object 3010. In FIG. 30, the witch's hand 3032 is projected at a first size. In FIG. 31, the witch's hand 3034 is projected at a second size that is larger than the first size. In FIG. 32, the witch's hand 3036 is projected at a third size that is larger than the first size and the second size. When the images of FIGS. 30, 31, and 32 are shown in sequence, the witch appears to be reaching out to the viewer. The images may be shown in sequence by activating the lights generating the images in sequence. In one embodiment, the animation is triggered by activation of a movement detector. The light sources may be arranged to project an image in the same location despite the film creating the image being in a different orientation. For example, the right light source may be to the right of the rightmost image to project the image somewhat to the left the film. The leftmost light source may be to the left of the leftmost the image to project the image to the right of the film.

Objects of other shapes and themes can be made that use complimentary light and shadow designs in accordance with an embodiment of the present invention.

Figure 33:
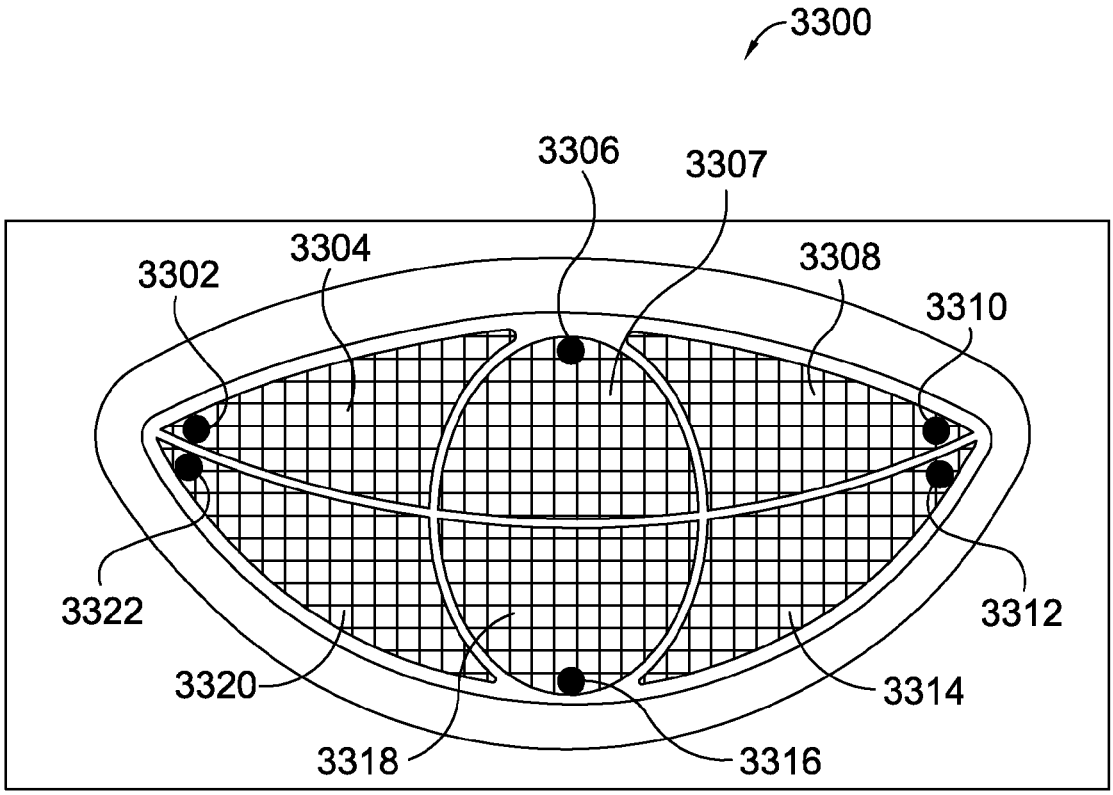
FIG. 33 depicts an illumination chassis using light pipes to distribute light within individual light chambers, in accordance with an embodiment of the present invention.

Turning now to FIG. 33, the inclusion of light pipes within a light chamber is shown, in accordance with an embodiment of the present invention. Previous embodiments describing an illumination chassis herein showed a light source relatively centered within an individual light chamber. For example, the light sources shown in FIG. 8 are roughly centered in their respective light chambers. Centering the light sources within the light chamber allows the light to be distributed throughout the individual chamber. A reflective backing may also help distribute light throughout the chamber.

In contrast, the light sources shown in FIG. 33 are located at the edge of the respective light chamber. In one embodiment, the light sources are horizontally oriented within the light chamber. In order to distribute light evenly through the light chamber, light pipes are included within individual light chambers. The light pipe receives light emitted from a light source associated with the chamber. Light escapes from the light pipe through light-extraction features, which may be described as outcouplers. The light-extraction features are distributed across the light pipe to evenly distribute light across the chamber. The light-extraction features may be arranged in a lattice and face the side of the chamber facing the translucent surface through which light is to pass. The light pipes may be sized to conform to the light chamber's exterior dimensions.

The light pipes may be built from thin, flat transparent acrylic material, which may be frosted on one of the flat surfaces. Light is directed into the acrylic through the edge, which may be polished. The frosted finish helps to draw light out from the flat surface. One advantage of this construction is that the overall depth of the assembly may be comparatively thin, supporting use in thinner items, such as greeting cards.

The light pipes may take the form of a sheet that conforms to the light chambers exterior. Each of these flat, planar sheets acts as a lightpipe. Light, for example, from LEDs, is provided to the edge of a sheet. The sheet/lightpipe has an edge reflector and one or more light-extraction features (e.g. outcouplers). The edge reflector is applied to the perimeter of the sheet/lightpipe. Its function is to return stray light back into the sheet/lightpipe. The edge reflector can be, for example, white paint, hot-foil, or reflecting tape. The light-extraction feature is applied to a face of the sheet/lightpipe. Its function is to allow light to escape the sheet/lightpipe, thereby illuminating the feature so that it can be seen by the viewer. The light-extraction feature can be anything that causes this effect. Examples include silkscreen, laser-etch, bead blast, foil stamp, litho, paint, crayon, marker, oil, adhesive, etc.

FIG. 33 shows an illumination chassis 3300 shaped like a mouth. Illumination chassis 3300 may be combined with an illumination chassis depicting a nose or eyes (not shown) to present a full set of facial features. The upper left light chamber includes light source 3302 and light pipe 3304. The upper central light chamber includes light source 3306 and light pipe 3307. The upper right light chamber includes light source 3310 and light pipe 3308. The lower right light chamber includes light source 3312 and light pipe 3314. The lower middle light chamber includes light source 3316 and light pipe 3318. The lower left light chamber includes light source 3322 and light pipe 3320. The partitions that form the chambers may be opaque to prevent light introduced into one light chamber from entering a second light chamber. The light pipes may be clear. The grid or lattice pattern shown with each light pipe is an exemplary outcoupler arrangement. Different facial expressions may be created by activating the light sources in sequence. These facial expressions are similar to the facial expressions described previously.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of an embodiment of the present invention.

It will be understood that certain features and subcombinations are of utility and may be employed without reference to other features and subcombinations and are contemplated within the scope of the claims.

What is claimed is:

1. A decorative object that produces a complimentary shadow design, the object comprising:

a housing having an opening and enclosing a controller that is coupled to one or more lights oriented to emit light out the opening, the housing having an appearance consistent with a holiday object; and a film connected to the housing and positioned across the opening, wherein the film includes an image thereon which reduces a passage of light through the film to project a visible image on a surface adjacent to the housing, and wherein the image compliments the holiday object, wherein the holiday object is a star and the visible image is at least part of a Christmas tree, the Christmas tree and the star oriented to make the star appear to be setting on the Christmas tree.

2. The decorative object of claim 1, wherein the surface is approximately perpendicular to the film.

3. The decorative object of claim 1, further comprising a memory having one or more sound files stored therein and a speaker for facilitating playback of the one or more sound files.

4. The decorative object of claim 1, further comprising a motion detector coupled to the controller, wherein the controller is programed to activate the one or more lights in response to a detection of motion by the motion detector.

5. A decorative object that produces a complimentary shadow design, the object comprising:

a housing having an opening and enclosing a controller that is coupled to one or more lights oriented to emit light out the opening, the housing having an appearance consistent with a holiday object; and a film connected to the housing and positioned across the opening, wherein the film includes an image thereon which reduces a passage of light through the film to project a visible image on a surface adjacent to the housing, and wherein the image compliments the holiday object, wherein the holiday object is a hat and the visible image is at least part of a face for a character associated with the hat, the face and the hat oriented to make the character appear to be wearing the hat.

6. The decorative object of claim 5, wherein the surface is approximately perpendicular to the film.

7. The decorative object of claim 5, further comprising a memory having one or more sound files stored therein and a speaker for facilitating playback of the one or more sound files.

8. The decorative object of claim 5, further comprising a motion detector coupled to the controller, wherein the controller is programed to activate the one or more lights in response to a detection of motion by the motion detector.

9. A decorative object that produces a complimentary shadow design, the object comprising:

a housing having an opening and enclosing a controller that is coupled to one or more lights oriented to emit light out the opening, the housing having an appearance consistent with a holiday object; and a film connected to the housing and positioned across the opening, wherein the film includes an image thereon which reduces a passage of light through the film to project a visible image on a surface adjacent to the housing, and wherein the image compliments the holiday object, wherein the holiday object is has the appearance of a pumpkin and the visible image is at least part of a jack-o-lantern face.

10. The decorative object of claim 9, wherein the surface is approximately perpendicular to the film.

11. The decorative object of claim 9, further comprising a memory having one or more sound files stored therein and a speaker for facilitating playback of the one or more sound files.

12. The decorative object of claim 9, further comprising a motion detector coupled to the controller, wherein the controller is programed to activate the one or more lights in response to a detection of motion by the motion detector.

* * * * *